US010541072B2

(12) United States Patent
Yoshidome et al.

(10) Patent No.: US 10,541,072 B2
(45) Date of Patent: Jan. 21, 2020

(54) SOFT MAGNETIC ALLOY

(71) Applicant: TDK CORPORATION, Tokyo (JP)

(72) Inventors: Kazuhiro Yoshidome, Tokyo (JP); Hiroyuki Matsumoto, Tokyo (JP); Yu Yonezawa, Tokyo (JP); Syota Goto, Tokyo (JP); Hideaki Yokota, Tokyo (JP); Akito Hasegawa, Tokyo (JP); Masahito Koeda, Tokyo (JP); Seigo Tokoro, Tokyo (JP)

(73) Assignee: TDK CORPORATION, Tokyo (JP)

( * ) Notice: Subject to any disclaimer, the term of this patent is extended or adjusted under 35 U.S.C. 154(b) by 170 days.

(21) Appl. No.: 15/718,757

(22) Filed: Sep. 28, 2017

(65) Prior Publication Data

US 2018/0096766 A1 Apr. 5, 2018

(30) Foreign Application Priority Data

Sep. 30, 2016 (JP) ..... 2016-194609

(51) Int. Cl.

| | |
|---|---|
| ***H01F 1/147*** | (2006.01) |
| ***C22C 38/02*** | (2006.01) |
| ***C22C 38/12*** | (2006.01) |
| ***C22C 38/16*** | (2006.01) |

(52) U.S. Cl.

CPC ..... *H01F 1/14766* (2013.01); *C22C 38/02* (2013.01); *C22C 38/12* (2013.01); *C22C 38/16* (2013.01); *C22C 2202/02* (2013.01)

(58) Field of Classification Search

CPC ..... H01F 1/14766; H01F 1/15308; H01F 1/15333; H01F 1/00; H01F 1/04; C22C 38/02; C22C 38/12; C22C 38/16; C22C 2202/02; B22D 39/06

See application file for complete search history.

(56) References Cited

U.S. PATENT DOCUMENTS 5,252,148 A * 10/1993 Shigeta ..... C22C 45/02 148/305
5,334,262 A * 8/1994 Sawa ..... B22D 11/0611 148/121
5,509,975 A 4/1996 Kojima et al.

(Continued)

FOREIGN PATENT DOCUMENTS

JP H04-018712 A 1/1992
JP H09-125135 A 5/1997

(Continued)

*Primary Examiner* — Anthony J Zimmer
*Assistant Examiner* — Ricardo D Morales
(74) *Attorney, Agent, or Firm* — Oliff PLC

(57) ABSTRACT

A soft magnetic alloy includes a main component of Fe. The soft magnetic alloy includes a Fe composition network phase where regions whose Fe content is larger than an average composition of the soft magnetic alloy are linked. The Fe composition network phase contains Fe content maximum points that are locally higher than their surroundings. A virtual-line total distance per 1 $\mu m^3$ of the soft magnetic alloy is 10 mm to 25 mm provided that the virtual-line total distance is a sum of virtual lines linking the maximum points adjacent each other. A virtual-line average distance that is an average distance of the virtual lines is 6 nm or more and 12 nm or less.

13 Claims, 9 Drawing Sheets

(56) References Cited

U.S. PATENT DOCUMENTS

| | | | | | |
|---|---|---|---|---|---|
| 5,549,419 | A * | 8/1996 | Kayahara | C04B 28/26 | 106/624 |
| 5,622,768 | A * | 4/1997 | Watanabe | H01F 1/15316 | 148/304 |
| 5,647,921 | A * | 7/1997 | Odagawa | B22D 11/0611 | 148/304 |
| 2010/0097171 | A1 * | 4/2010 | Urata | B22F 9/08 | 336/233 |

FOREIGN PATENT DOCUMENTS

| | | | |
|---|---|---|---|
| JP | 2000-030924 | A | 1/2000 |
| JP | 3460763 | B2 | 10/2003 |

* cited by examiner

SOFT MAGNETIC ALLOY

BACKGROUND OF THE INVENTION

1. Field of the Invention

The present invention relates to a soft magnetic alloy.

2. Description of the Related Art

Low power consumption and high efficiency have been demanded in electronic, information, communication equipment, and the like. Moreover, the above demands are becoming stronger for a low carbon society. Thus, reduction in energy loss and improvement in power supply efficiency are also required for power supply circuits of electronic, information, communication equipment, and the like. Then, improvement in permeability and reduction in core loss (magnetic core loss) are required for the magnetic core of the ceramic element used in the power supply circuit. If the core loss is reduced, the loss of power energy is reduced, and high efficiency and energy saving are achieved.

Patent Document 1 discloses that a soft magnetic alloy powder having a large permeability and a small core loss and suitable for magnetic cores is obtained by changing the particle shape of the powder. However, magnetic cores having a larger permeability and a smaller core loss are required now.

Patent Document 1: JP 2000-30924 A

SUMMARY OF THE INVENTION

As a method of reducing the core loss of the magnetic core, it is conceivable to reduce coercivity of a magnetic material constituting the magnetic core.

It is an object of the invention to provide a soft magnetic alloy having a low coercivity and a high permeability.

To achieve the above object, the soft magnetic alloy according to the present invention is a soft magnetic alloy comprising a main component of Fe, wherein the soft magnetic alloy comprises a Fe composition network phase where regions whose Fe content is larger than an average composition of the soft magnetic alloy are linked;

the Fe composition network phase contains Fe content maximum points that are locally higher than their surroundings;

a virtual-line total distance per 1 $\mu m^3$ of the soft magnetic alloy is 10 mm to 25 mm provided that the virtual-line total distance is a sum of virtual lines linking the maximum points adjacent each other; and a virtual-line average distance that is an average distance of the virtual lines is 6 nm or more and 12 nm or less.

The soft magnetic alloy according to the present invention comprises the Fe composition network phase, and thus has a low coercivity and a high permeability.

In the soft magnetic alloy according to the present invention, a standard deviation of distances of the virtual lines is preferably 6 nm or less.

In the soft magnetic alloy according to the present invention, an existence ratio of the virtual lines having a distance of 4 nm or more and 16 nm or less is preferably 80% or more.

In the soft magnetic alloy according to the present invention, a volume ratio of the Fe composition network phase is preferably 25 vol % or more and 50 vol % or less with respect to the entire soft magnetic alloy.

In the soft magnetic alloy according to the present invention, a volume ratio of the Fe composition network phase is preferably 30 vol % or more and 40 vol % or less with respect to the entire soft magnetic alloy.

DESCRIPTION OF THE PREFERRED EMBODIMENTS

Figure 1:
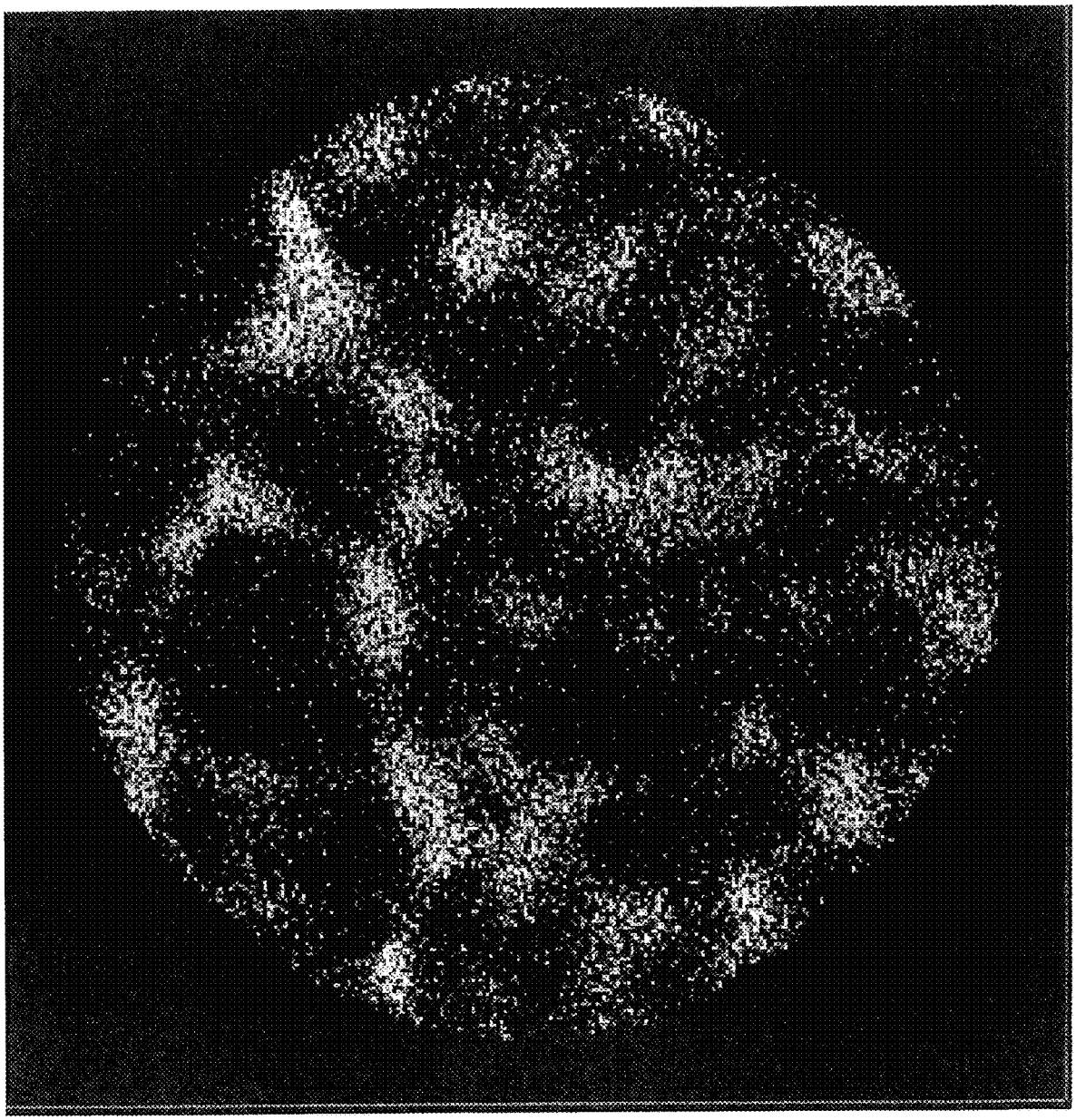
FIG. 1 is a photograph of a Fe concentration distribution of a soft magnetic alloy according to an embodiment of the present invention observed using a three-dimensional atom probe.

Hereinafter, an embodiment of the present invention will be described.

A soft magnetic alloy according to the present embodiment is a soft magnetic alloy whose main component is Fe. Specifically, "main component is Fe" means a soft magnetic alloy whose Fe content is 65 atom % or more with respect to the entire soft magnetic alloy.

Except that main component is Fe, the soft magnetic alloy according to the present embodiment has any composition. The soft magnetic alloy according to the present embodiment may be a Fe—Si-M-B—Cu—C based soft magnetic alloy, a Fe-M'-B—C based soft magnetic alloy, or another soft magnetic alloy.

In the following description, the entire soft magnetic alloy is considered to be 100 atom % if there is no description of parameter with respect to content ratio of each element of the soft magnetic alloy.

When a Fe—Si-M-B—Cu—C based soft magnetic alloy is used, the following formulae are preferably satisfied if the Fe—Si-M-B—Cu—C based soft magnetic alloy has a composition expressed by $Fe_aCu_bM_cSi_dB_eC_f$. When the following formulae are satisfied, a virtual-line total distance and a virtual-line average distance mentioned below tend to be large, a favorable Fe composition network phase tends to be obtained easily, and a soft magnetic alloy having a low coercivity and a high permeability tends to be obtained easily. Incidentally, a soft magnetic alloy composed of the following compositions is made of comparatively inexpensive raw materials. The Fe—Si-M-B—Cu—C based soft magnetic alloy of the present application also includes a soft magnetic alloy with f=0, that is, failing to contain C.

$$a+b+c+d+e+f=100$$

$$0.1 \leq b \leq 3.0$$

$1.0 \leq c \leq 10.0$ $11.5 \leq d \leq 17.5$ $7.0 \leq e \leq 13.0$ $0.0 \leq f \leq 4.0$ A Cu content (b) is preferably 0.1 to 3.0 atom %, more preferably 0.5 to 1.5 atom %. The smaller a Cu content is, the more easily a ribbon composed of the soft magnetic alloy tends to be prepared by a single roll method mentioned below.

M is a transition metal element other than Cu. M is preferably one or more selected from a group of Nb, Ti, Zr, Hf, V, Ta, and Mo. Preferably, M contains Nb.

A M content (c) is preferably 1.0 to 10.0 atom %, more preferably 3.0 to 5.0 atom %.

A Si content (d) is preferably 11.5 to 17.5 atom %, more preferably 13.5 to 15.5 atom %.

A B content (e) is preferably 7.0 to 13.0 atom %, more preferably 9.0 to 11.0 atom %.

A C content (f) is preferably 0.0 to 4.0 atom %. Amorphousness is improved by addition of C.

Incidentally, Fe is, so to speak, a remaining part of the Fe—Si-M-B—Cu—C based soft magnetic alloy according to the present embodiment.

When the Fe-M'-B—C based soft magnetic alloy is used, the following formulae are preferably satisfied if the Fe-M'-B—C based soft magnetic alloy has a composition expressed by $Fe_{\alpha}M'_{\beta}B_{\gamma}C_{\Omega}$. When the following formulae are satisfied, a virtual-line total distance and a virtual-line average distance mentioned below tend to be large, a favorable Fe composition network phase tends to be obtained easily, and a soft magnetic alloy having a low coercivity and a high permeability tends to be obtained easily. Incidentally, a soft magnetic alloy composed of the following compositions is made of comparatively inexpensive raw materials. The Fe-M'-B—C based soft magnetic alloy of the present application also includes a soft magnetic alloy with $\Omega=0$, that is, failing to contain C.

$\alpha+\beta+\gamma+\Omega=100$ $1.0 \leq \beta \leq 14.1$ $2.0 \leq \gamma \leq 20.0$ $0.0 \leq \Omega \leq 4.0$ M' is a transition metal element. M' is preferably one or more element selected from a group of Nb, Cu, Cr, Zr, and Hf M' is more preferably one or more element selected from a group of Nb, Cu, Zr, and Hf. M' most preferably contains one or more element selected from a group of Nb, Zr, and Hf.

A M' content ($\beta$) is preferably 1.0 to 14.1 atom %, more preferably 7.0 to 10.1 atom %.

A Cu content in M' is preferably 0.0 to 2.0 atom %, more preferably 0.1 to 1.0 atom %, provided that an entire soft magnetic alloy is 100 atom %. When a M' content is less than 7.0 atom %, however, failing to contain Cu may be preferable.

A B content ($\gamma$) is preferably 2.0 to 20.0 atom %. When M' contains Nb, a B content ($\gamma$) is preferably 4.5 to 18.0 atom %. When M' contains Zr and/or Hf, a B content ($\gamma$) is preferably 2.0 to 8.0 atom %. The smaller a B content is, the further amorphousness tends to deteriorate. The larger a B content is, the further the number of maximum points mentioned below tends to decrease.

A C content ($\Omega$) is preferably 0.0 to 4.0 atom %, more preferably 0.1 to 3.0 atom %. Amorphousness is improved by addition of C. The larger a C content is, the further the number of maximum points mentioned below tends to decrease.

Another soft magnetic alloy may be a Fe-M"-B—P—C based soft magnetic alloy, a Fe—Si—P—B—Cu—C based soft magnetic alloy, or the like.

When a Fe-M"-B—P—C based soft magnetic alloy is used, the following formulae are preferably satisfied if the Fe-M"-B—P—C based soft magnetic alloy has a composition expressed by $Fe_vM''_wB_xP_yC_z$. When the following formulae are satisfied, the number of maximum points mentioned below tends to increase, a favorable Fe composition network phase tends to be obtained easily, and a soft magnetic alloy having a low coercivity and a high permeability tends to be obtained easily. Incidentally, a soft magnetic alloy composed of the following compositions is made of comparatively inexpensive raw materials. The Fe-M"-B—P—C based soft magnetic alloy of the present application also includes a soft magnetic alloy with z=0, that is, failing to contain C.

$v+w+x+y+z=100$ $3.2 \leq w \leq 15.5$ $2.8 \leq x \leq 13.0$ $0.1 \leq y \leq 3.0$ $0.0 \leq z \leq 2.0$ M" is a transition metal element. M" is preferably one or more elements selected from a group of Nb, Cu, Cr, Zr, and Hf. M" preferably contains Nb.

When a Fe—Si—P—B—Cu—C based soft magnetic alloy is used, the following formulae are preferably satisfied if the Fe—Si—P—B—Cu—C based soft magnetic alloy a composition expressed by $Fe_vSi_{w1}P_{w2}B_xCu_yC_z$. When the following formulae are satisfied, the number of maximum points mentioned below tends to increase, a favorable Fe composition network phase tends to be obtained easily, and a soft magnetic alloy having a low coercivity and a high permeability tends to be obtained easily. Incidentally, a soft magnetic alloy composed of the following compositions is made of comparatively inexpensive raw materials. The Fe—Si—P—B—Cu—C based soft magnetic alloy of the present application also includes a soft magnetic alloy with w1=0 or w2=0 (i.e., Si or P is not contained). The Fe—Si—P—B—Cu—C based soft magnetic alloy of the present application also includes a soft magnetic alloy with z=0 (i.e., Cu is not contained).

$v+w1+w2+x+y+z=100$ $0.0 \leq w1 \leq 8.0$ $0.0 \leq w2 \leq 8.0$ $3.0 \leq w1+w2 \leq 11.0$ $5.0 \leq x \leq 13.0$ $0.1 \leq y \leq 0.7$ $0.0 \leq z \leq 4.0$ Here, the Fe composition network phase owned by the soft magnetic alloy according to the present embodiment will be described.

Figure 2:
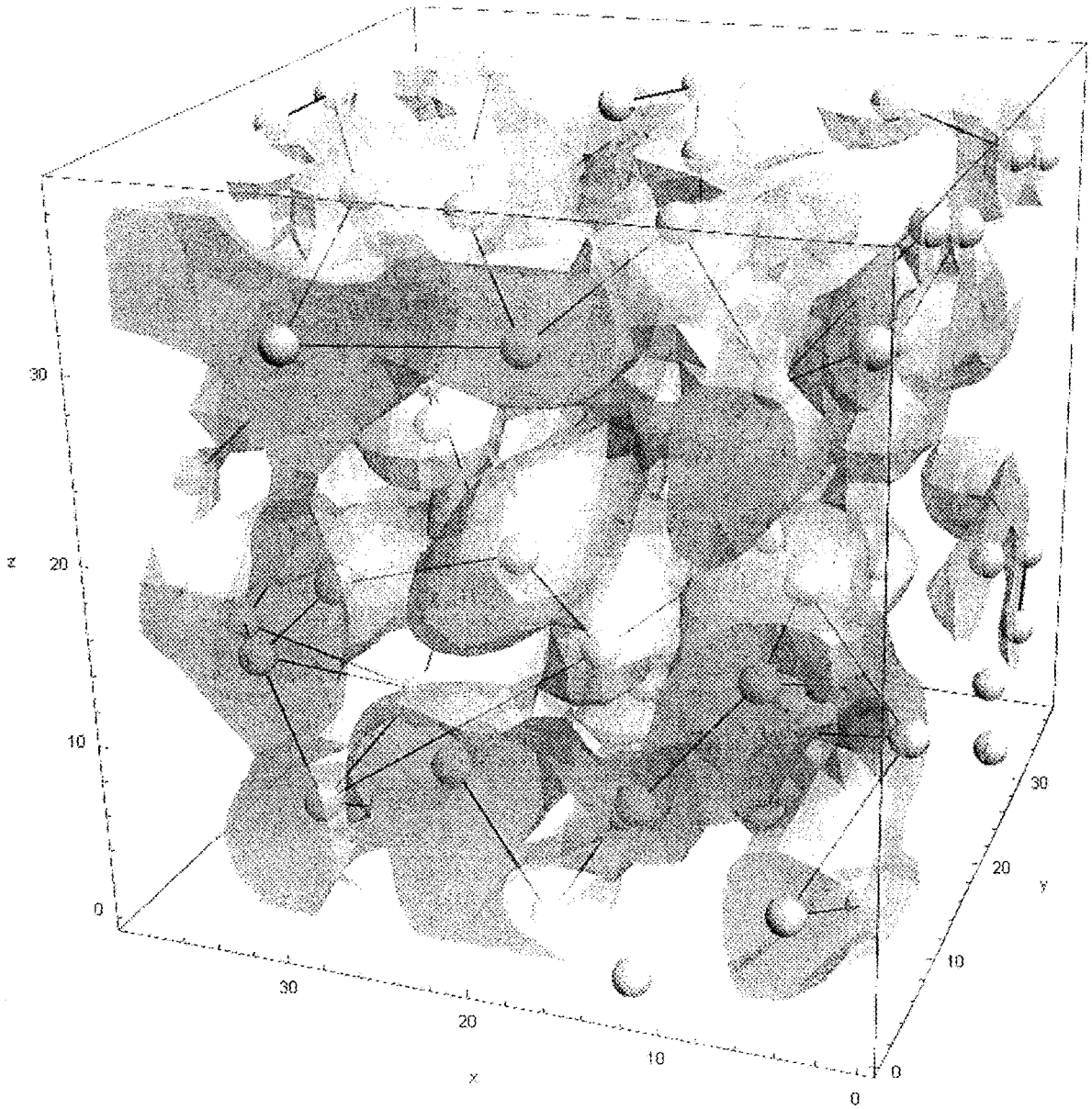
FIG. 2 is a photograph of a network structure model owned by a soft magnetic alloy according to an embodiment of the present invention.

The Fe composition network phase is a phase whose Fe content is higher than an average composition of the soft magnetic alloy. When observing a Fe concentration distribution of the soft magnetic alloy according to the present embodiment using a three-dimensional atom probe (hereinafter also referred to as a 3DAP) with a thickness of 5 nm, it can be observed that portions having a high Fe content are distributed in network as shown in FIG. 1. FIG. 2 is a schematic view obtained by three-dimensionalizing this distribution. Incidentally, FIG. 1 is an observation result of Sample No. 39 in Examples mentioned below using a 3DAP.

In conventional soft magnetic alloys containing Fe, a plurality of portions having a high Fe content respectively has a spherical shape or an approximately spherical shape and exists at random via portions having a low Fe content. The soft magnetic alloy according to the present embodiment is characterized in that portions having a high Fe content are linked in network and distributed as shown in FIG. 2.

An aspect of the Fe composition network phase can be quantified by measuring a virtual-line total distance and a virtual-line average distance mentioned below.

Hereinafter, an analysis procedure of the Fe composition network phase according to the present embodiment will be described using the figures, and calculation methods of a virtual-line total distance and a virtual-line average distance will be thereby described.

First, a definition of a maximum point of the Fe composition network phase and a confirmation method of the maximum point will be described. The maximum point of the Fe composition network phase is a Fe content point that is locally higher than its surroundings.

A cube whose length of one side is 40 nm is determined as a measurement range, and this cube is divided into cubic grids whose length of one side is 1 nm. That is, 64,000 grids (40×40×40=64000) exist in one measurement range.

Next, a Fe content in each grid is evaluated. Then, a Fe content average value (hereinafter also referred to as a threshold value) in all of the grids is calculated. The Fe content average value is a value substantially equivalent to a value calculated from an average composition of each soft magnetic alloy.

Figure 3:
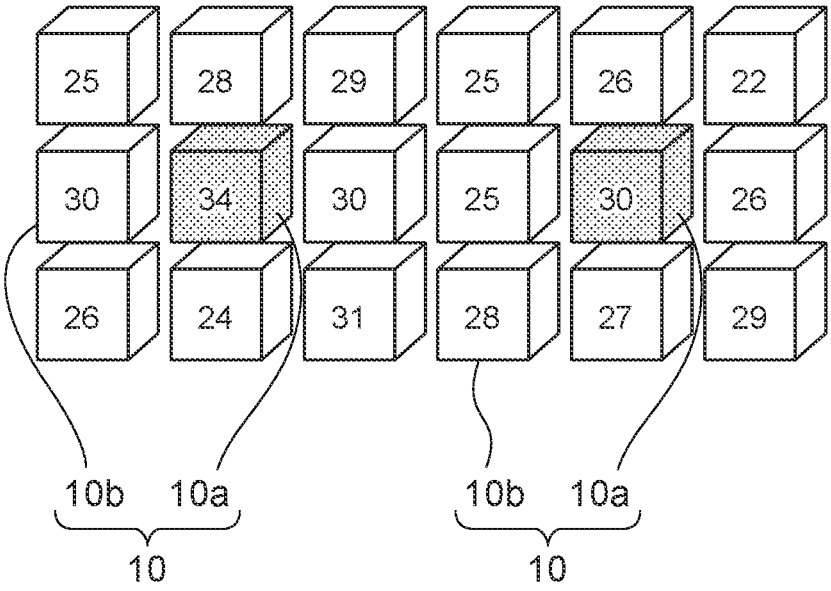
FIG. 3 is a schematic view of a step of searching maximum points.

Next, a grid whose Fe content exceeds the threshold value and is equal to or higher than that of all adjacent unit grids is determined as a maximum point. FIG. 3 shows a model showing a step of searching the maximum points. Numbers written inside each grid 10 represent a Fe content in each grid. Maximum points 10*a* are determined as a grid whose Fe content is equal to or larger than Fe contents of all adjacent grids 10*b*.

FIG. 3 shows eight adjacent grids 10*b* with respect to a single maximum point 10*a*, but in fact nine adjacent grids 10*b* also exist respectively front and back the maximum points 10*a* of FIG. 3. That is, 26 adjacent grids 10*b* exist with respect to the single maximum point 10*a*.

With respect to grids 10 located at the end of the measurement range, grids whose Fe content is zero are considered to exist outside the measurement range.

Figure 4:
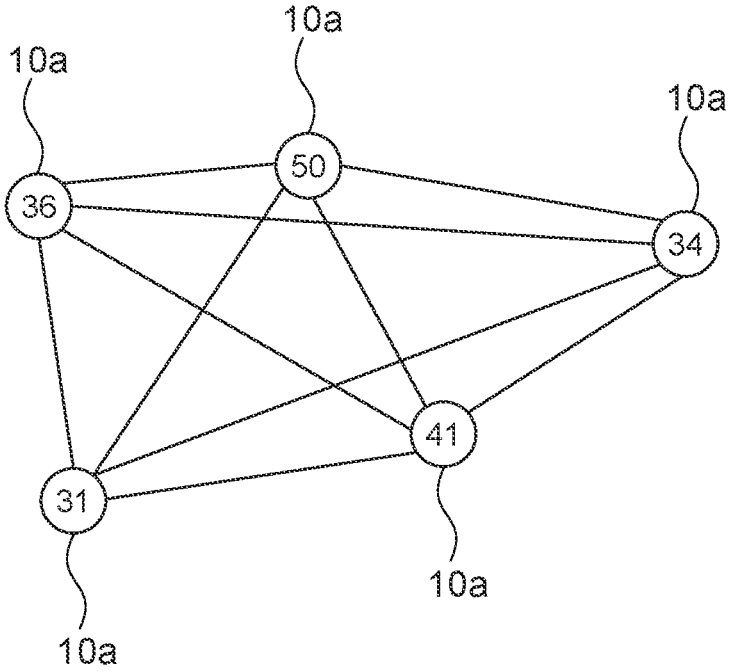
FIG. 4 is a schematic view of a state where virtual lines linking all of the maximum points are formed.

Next, as shown in FIG. 4, line segments linking all of the maximum points 10*a* contained in the measurement range are drawn. These line segments are virtual lines. When drawing the virtual lines, centers of each grid are connected to each other. Incidentally, the maximum points 10*a* are represented as circles for convenience of description in FIG. 4 to FIG. 7. Numbers written inside the circles represent a Fe content.

Figure 5:
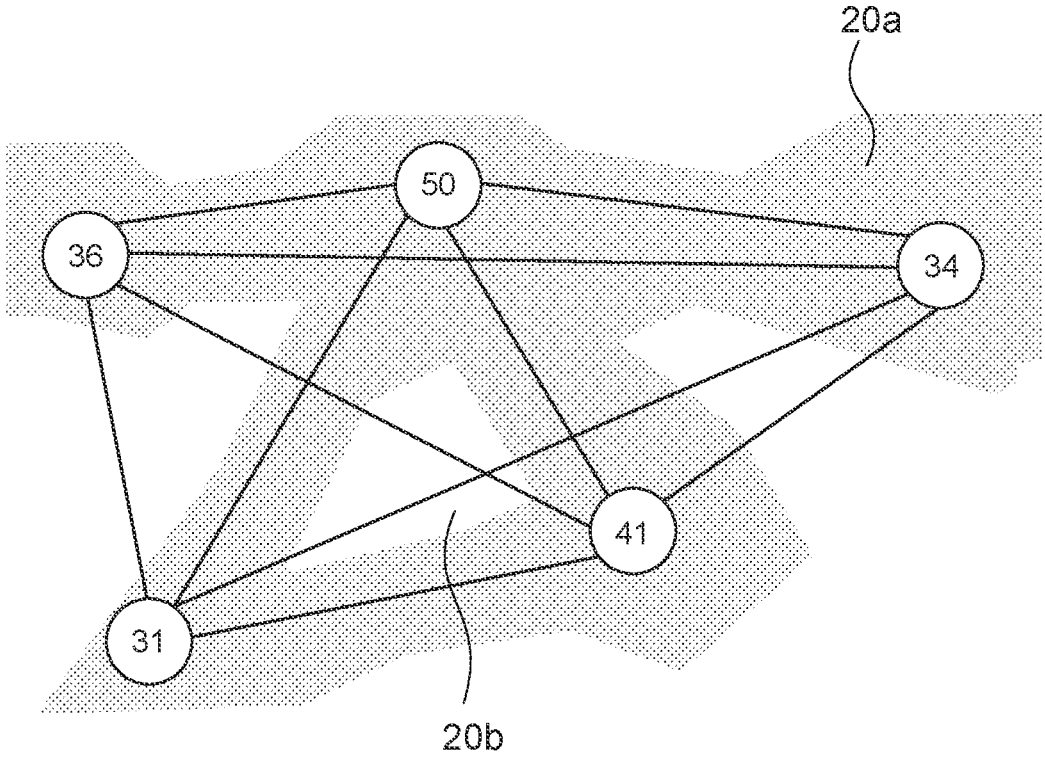
FIG. 5 is a schematic view of a divided state of a region whose Fe content is more than an average value and a region whose Fe content is an average value or less.
Figure 6:
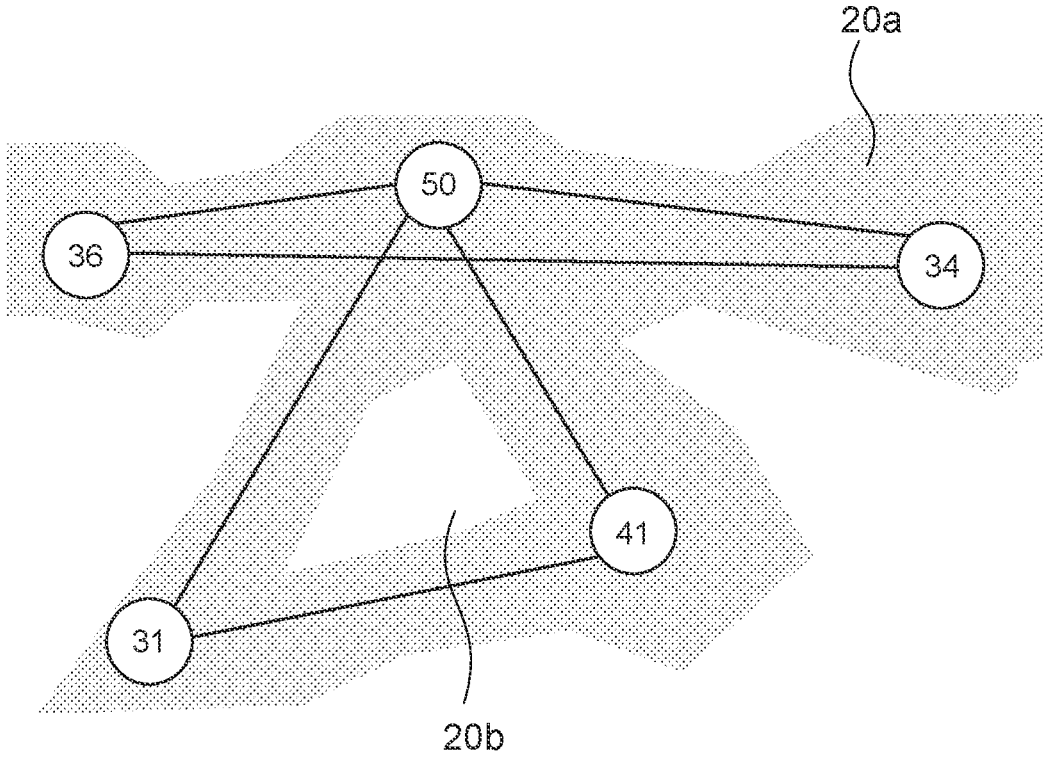
FIG. 6 is a schematic view of a deleted state of virtual lines passing through the region whose Fe content is an average value or less.

Next, as shown in FIG. 5, the measurement range is divided into a region 20*a* whose Fe content is higher than a threshold value (=Fe composition network phase) and a region 20*b* whose Fe content is a threshold value or less. Then, as shown in FIG. 6, line segments passing through the region 20*b* are deleted.

Virtual lines linking between a maximum point of a grid existing on the outermost surface in the measurement range of 40 nm×40 nm×40 nm and a maximum point of another grid existing on the same outermost surface are deleted. When calculating a virtual-line average distance and a virtual-line standard deviation mentioned below, virtual lines passing through maximum points of grids existing on the outermost surface are excluded from this calculation.

Figure 7:
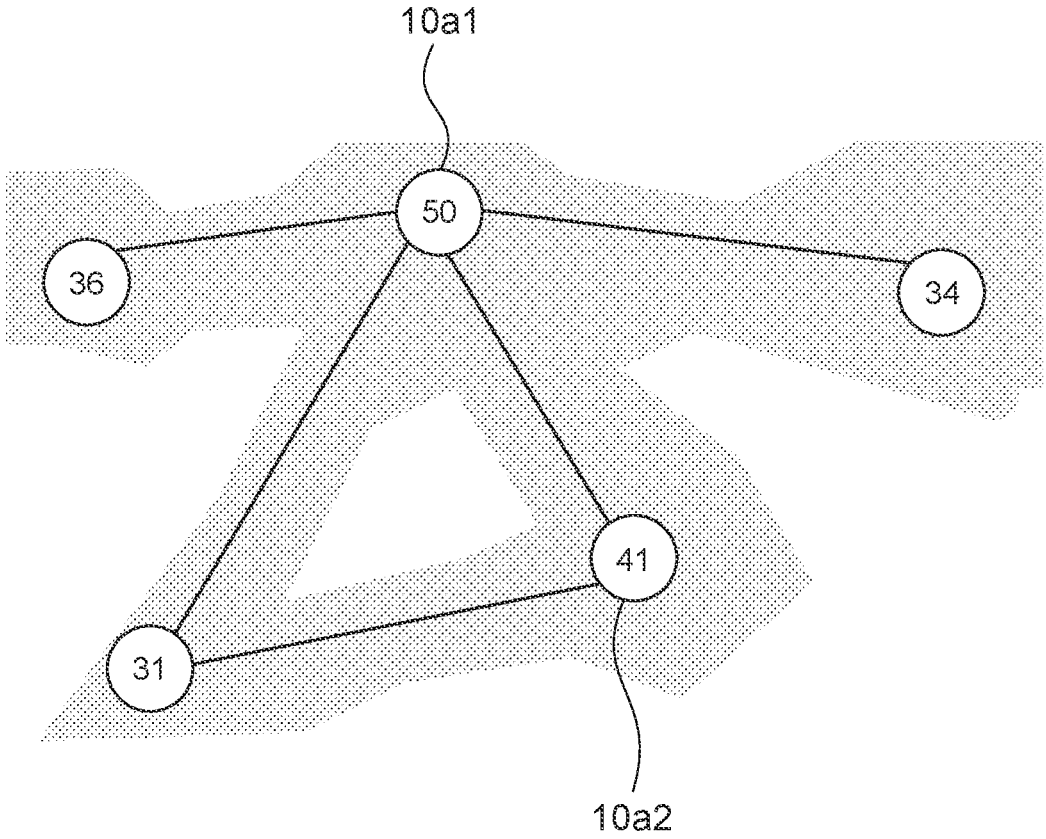
FIG. 7 is a schematic view of a state where the longest virtual line of virtual lines forming a triangle is deleted when the triangle contains no region whose Fe content is an average value or less.

Next, as shown in FIG. 7, when no region 20*b* exists inside a triangle formed by the virtual lines, the longest line segment of three line segments constituting this triangle is deleted. Finally, when maximum points exist in adjacent grids, virtual lines linking the maximum points are deleted.

The virtual-line total distance is calculated by summing lengths of virtual lines remaining in the measurement range. Moreover, the number of virtual lines is calculated, and the virtual-line average distance, which is a distance of one virtual line, is calculated.

Incidentally, the Fe composition network phase also includes a maximum point having no virtual lines and a region existing in surroundings of this maximum point and having a Fe content that is higher than a threshold value.

The accuracy of calculation results can be sufficiently highly improved by conducting the above-mentioned measurement several times in respectively different measurement ranges. The above-mentioned measurement is preferably conducted three times or more in respectively different measurement ranges.

In the Fe composition network phase owned by the soft magnetic alloy according to the present embodiment, the virtual-line total distance per 1 $\mu m^3$ of the soft magnetic alloy is 10 mm to 25 mm, and the virtual-line average distance, that is, an average of distances of virtual lines, is 6 nm or more and 12 nm or less.

The soft magnetic alloy according to the present embodiment can have a low coercivity and a high permeability and excel in soft magnetic properties particularly in high frequencies by having a Fe composition network phase whose virtual-line total distance and virtual-line average distance are within the above ranges.

Preferably, a standard deviation of distances of the virtual lines is 6 nm or less.

Preferably, an existence ratio of virtual lines having a distance of 4 nm or more and 16 nm or less is 80% or more.

Moreover, a volume ratio of the Fe composition network phase (a volume ratio of the region 20*a* whose Fe content is higher than a threshold value to a total of the region 20*a* whose Fe content is higher than a threshold value and the region 20*b* whose Fe content is a threshold value or less) is preferably 25 vol % or more and 50 vol % or less, more preferably 30 vol % or more and 40 vol % or less, with respect to the entire soft magnetic alloy.

When comparing a Fe—Si-M-B—Cu—C based soft magnetic alloy with a Fe-M'-B—C based soft magnetic alloy, the Fe-M'-B—C based soft magnetic alloy tends to have a longer virtual-line total distance, and the Fe—Si-M-B—Cu—C based soft magnetic alloy tends to have a longer virtual-line average distance.

When comparing a Fe—Si-M-B—Cu—C based soft magnetic alloy with a Fe-M'-B—C based soft magnetic alloy, the Fe—Si-M-B—Cu—C based soft magnetic alloy tends to have a lower coercivity and a higher permeability than those of the Fe-M'-B—C based soft magnetic alloy.

Hereinafter, a manufacturing method of the soft magnetic alloy according to the present embodiment will be described.

The soft magnetic alloy according to the present embodiment is manufactured by any method. For example, a ribbon of the soft magnetic alloy according to the present embodiment is manufactured by a single roll method.

In the single roll method, first, pure metals of metal elements contained in a soft magnetic alloy finally obtained are prepared and weighed so that a composition identical to that of the soft magnetic alloy finally obtained is obtained. Then, the pure metals of each metal element are molten and mixed, and a base alloy is prepared. Incidentally, the pure metals are molten by any method. For example, the pure metals are molten by high-frequency heating after a chamber is evacuated. Incidentally, the base alloy and the soft magnetic alloy finally obtained normally have the same composition.

Next, the prepared base alloy is heated and molten, and a molten metal is obtained. The molten metal has any temperature, and may have a temperature of 1200 to 1500° C., for example.

Figure 8:
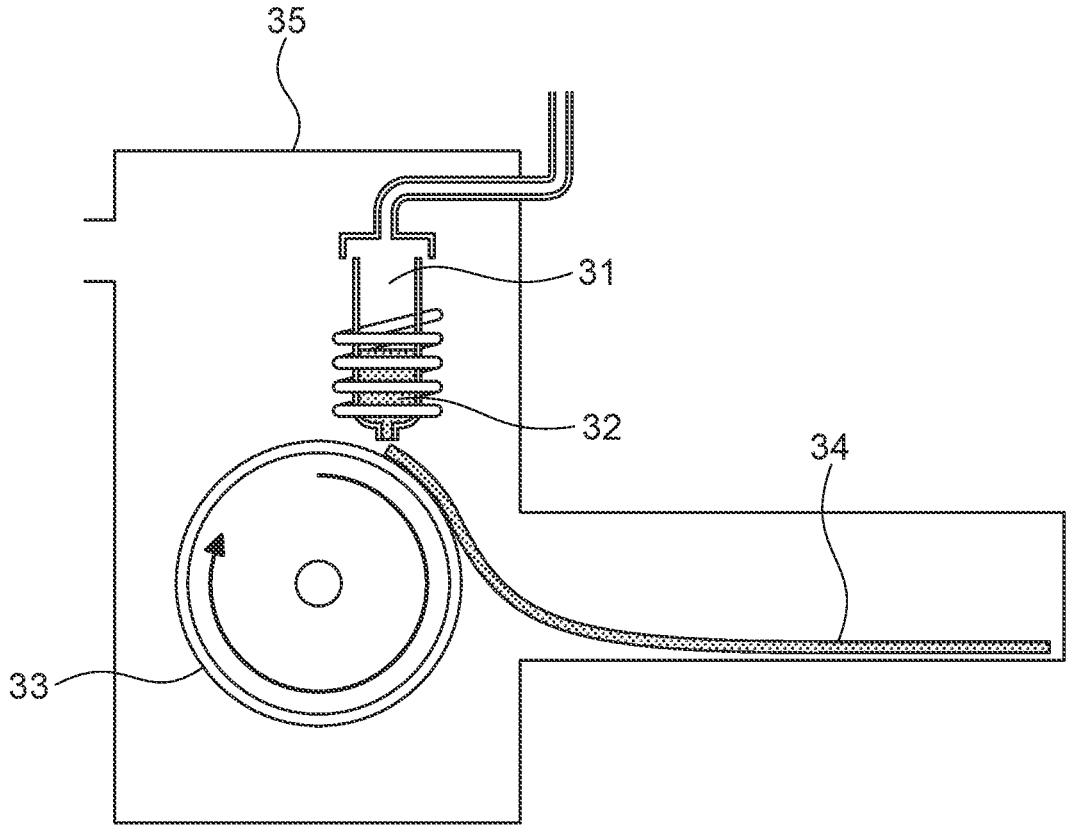
FIG. 8 is a schematic view of a single roll method.

FIG. 8 shows a schematic view of an apparatus used for the single roll method. In the single roll method according to the present embodiment, a molten metal 32 is supplied by being sprayed from a nozzle 31 against a roll 33 rotating toward the direction of the arrow in a chamber 35, and a ribbon 34 is thus manufactured toward the rotating direction of the roll 33. Incidentally, the roll 33 is made of any material, such as a roll composed of Cu.

In the single roll method, the thickness of the ribbon to be obtained can be mainly controlled by controlling a rotating speed of the roll 33, but can be also controlled by controlling a distance between the nozzle 31 and the roll 33, a temperature of the molten metal, or the like. The ribbon has any thickness, and may have a thickness of 15 to 30 μm, for example.

The ribbon is preferably amorphous before a heat treatment mentioned below. The amorphous ribbon undergoes a heat treatment mentioned below, and the above-mentioned favorable Fe composition network phase can be thereby obtained.

Incidentally, whether the ribbon of the soft magnetic alloy before a heat treatment is amorphous or not is confirmed by any method. Here, the fact that the ribbon is amorphous means that the ribbon contains no crystals. For example, the existence of crystals whose particle size is about 0.01 to 10 μm can be confirmed by a normal X-ray diffraction measurement. When crystals exist in the above amorphous phase but their volume ratio is small, a normal X-ray diffraction measurement can determine that no crystals exist. In this case, for example, the existence of crystals can be confirmed by obtaining a restricted visual field diffraction image, a nano beam diffraction image, a bright field image, or a high resolution image of a sample thinned by ion milling using a transmission electron microscope. When using a restricted visual field diffraction image or a nano beam diffraction image, with respect to diffraction pattern, a ring-shaped diffraction is formed in case of being amorphous, and diffraction spots due to crystal structure are formed in case of being non-amorphous. When using a bright field image or a high resolution image, the existence of crystals can be confirmed by visually observing the image with a magnification of $1.00\times10^5$ to $3.00\times10^5$. In the present specification, it is considered that "crystals exist" if crystals can be confirmed to exist by a normal X-ray diffraction measurement, and it is considered that "microcrystals exist" if crystals cannot be confirmed to exist by a normal X-ray diffraction measurement but can be confirmed to exist by obtaining a restricted visual field diffraction image, a nano beam diffraction image, a bright field image, or a high resolution image of a sample thinned by ion milling using a transmission electron microscope.

Here, the present inventors have found that when a temperature of the roll 33 and a vapor pressure in the chamber 35 are controlled appropriately, a ribbon of a soft magnetic alloy before a heat treatment becomes amorphous easily, and a favorable Fe composition network phase is easily obtained after the heat treatment. Specifically, the present inventors have found that a ribbon of a soft magnetic alloy becomes amorphous easily by setting a temperature of the roll 33 to 50 to 70° C., preferably 70° C., and setting a vapor pressure in the chamber 35 to 11 hPa or less, preferably 4 hPa or less, using an Ar gas whose dew point is adjusted.

In a single roll method, it is conventionally considered that increasing a cooling rate and rapidly cooling the molten metal 32 are preferable, and that the cooling rate is preferably increased by widening a temperature difference between the molten metal 32 and the roll 33. It is thus considered that the roll 33 preferably normally has a temperature of about 5 to 30° C. The present inventors, however, have found that when the roll 33 has a temperature of 50 to 70° C., which is higher than that of a conventional roll method, and a vapor pressure in the chamber 35 is 11 hPa or less, the molten metal 32 is cooled uniformly, and a ribbon of a soft magnetic alloy to be obtained before a heat treatment easily becomes uniformly amorphous. Incidentally, a vapor pressure in the chamber has no lower limit. The vapor pressure may be adjusted to 1 hPa or less by filling the chamber with an Ar gas whose dew point is adjusted or by controlling the chamber to a state close to vacuum. When the vapor pressure is high, an amorphous ribbon before a heat treatment is hard to be obtained, and the above-mentioned favorable Fe composition network phase is hard to be obtained after a heat treatment mentioned below even if an amorphous ribbon before a heat treatment is obtained.

The obtained ribbon 34 undergoes a heat treatment, and the above-mentioned favorable Fe composition network phase can be thereby obtained. In this case, the above-mentioned favorable Fe composition network phase is easily obtained if the ribbon 34 is completely amorphous.

There is no limit to conditions of the heat treatment. Favorable conditions of the heat treatment differ depending on composition of a soft magnetic alloy. Normally, a heat treatment temperature is preferably about 500 to 600° C., and a heat treatment time is preferably about 0.5 to 10 hours, but favorable heat treatment temperature and heat treatment time may be in a range deviated from the above ranges depending on the composition.

In addition to the above-mentioned single roll method, a powder of the soft magnetic alloy according to the present embodiment is obtained by a water atomizing method or a gas atomizing method, for example. Hereinafter, a gas atomizing method will be described.

In a gas atomizing method, a molten alloy of 1200 to 1500° C. is obtained similarly to the above-mentioned single roll method. Thereafter, the molten alloy is sprayed in a chamber, and a powder is prepared.

At this time, the above-mentioned favorable Fe composition network phase is finally easily obtained with a gas spray temperature of 50 to 100° C. and a vapor pressure of 4 hPa or less in the chamber.

After the powder is prepared by the gas atomizing method, a heat treatment is conducted at 500 to 650° C. for 0.5 to 10 minutes. This makes it possible to promote diffusion of elements while the powder is prevented from being coarse due to sintering of each particle, reach a thermodynamic equilibrium state for a short time, remove distortion and stress, and easily obtain a Fe composition network phase. It is then possible to obtain a soft magnetic alloy powder having soft magnetic properties that are favorable particularly in high-frequency regions.

An embodiment of the present invention has been accordingly described, but the present invention is not limited to the above-mentioned embodiment.

The soft magnetic alloy according to the present embodiment has any shape, such as a ribbon shape and a powder shape as described above. The soft magnetic alloy according to the present embodiment may also have a block shape.

The soft magnetic alloy according to the present embodiment is used for any purpose, such as for magnetic cores, and can be favorably used for magnetic cores for inductors, particularly for power inductors. In addition to magnetic cores, the soft magnetic alloy according to the present embodiment can be also favorably used for thin film inductors, magnetic heads, transformers, and the like.

Hereinafter, a method for obtaining a magnetic core and an inductor from the soft magnetic alloy according to the preset embodiment will be described, but is not limited to the following method.

For example, a magnetic core from a ribbon-shaped soft magnetic alloy is obtained by winding or laminating the ribbon-shaped soft magnetic alloy. When a ribbon-shaped soft magnetic alloy is laminated via an insulator, a magnetic core having further improved properties can be obtained.

For example, a magnetic core from a powder-shaped soft magnetic alloy is obtained by appropriately mixing the powder-shaped soft magnetic alloy with a binder and pressing this using a die. When an oxidation treatment, an insulation coating, or the like is carried out against the surface of the powder before mixing with the binder, resistivity is improved, and a magnetic core further suitable for high-frequency regions is obtained.

The pressing method is not limited. Examples of the pressing method include a pressing using a die and a mold pressing. There is no limit to the kind of the binder. Examples of the binder include a silicone resin. There is no limit to a mixture ratio between the soft magnetic alloy powder and the binder either. For example, 1 to 10 mass % of the binder is mixed in 100 mass % of the soft magnetic alloy powder.

For example, 100 mass % of the soft magnetic alloy powder is mixed with 1 to 5 mass % of a binder and compressively pressed using a die, and it is thereby possible to obtain a magnetic core having a space factor (powder filling rate) of 70% or more, a magnetic flux density of 0.4 T or more at the time of applying a magnetic field of $1.6\times10^4$ A/m, and a resistivity of 1 Ω·cm or more. These properties are more excellent than those of normal ferrite magnetic cores.

For example, 100 mass % of the soft magnetic alloy powder is mixed with 1 to 3 mass % of a binder and compressively pressed using a die under a temperature condition that is equal to or higher than a softening point of the binder, and it is thereby possible to obtain a dust core having a space factor of 80% or more, a magnetic flux density of 0.9 T or more at the time of applying a magnetic field of $1.6\times10^4$ A/m, and a resistivity of 0.1 Ω·cm or more. These properties are more excellent than those of normal dust cores.

Moreover, a green compact constituting the above-mentioned magnetic core undergoes a heat treatment after pressing as a heat treatment for distortion removal. This further decreases core loss and improves usability.

An inductance product is obtained by winding a wire around the above-mentioned magnetic core. The wire is wound by any method, and the inductance product is manufactured by any method. For example, a wire is wound around a magnetic core manufactured by the above-mentioned method at least in one or more turns.

Moreover, when soft magnetic alloy particles are used, there is a method of manufacturing an inductance product by pressing and integrating a magnetic body incorporating a wire coil. In this case, an inductance product corresponding to high frequencies and large current is obtained easily.

Moreover, when soft magnetic alloy particles are used, an inductance product can be obtained by carrying out heating and firing after alternately printing and laminating a soft magnetic alloy paste obtained by pasting the soft magnetic alloy particles added with a binder and a solvent and a conductor paste obtained by pasting a conductor metal for coils added with a binder and a solvent. Instead, an inductance product where a coil is incorporated in a magnetic body can be obtained by preparing a soft magnetic alloy sheet using a soft magnetic alloy paste, printing a conductor paste on the surface of the soft magnetic alloy sheet, and laminating and firing them.

Here, when an inductance product is manufactured using soft magnetic alloy particles, in view of obtaining excellent Q properties, it is preferred to use a soft magnetic alloy powder whose maximum particle size is 45 μm or less by sieve diameter and center particle size (D50) is 30 μm or less. In order to have a maximum particle size of 45 μm or less by sieve diameter, only a soft magnetic alloy powder that passes through a sieve whose mesh size is 45 μm may be used.

The larger a maximum particle size of a soft magnetic alloy powder is, the further Q values in high-frequency regions tend to decrease. In particular, when using a soft magnetic alloy powder whose maximum particle diameter is more than 45 μm by sieve diameter, Q values in high-frequency regions may decrease greatly. When emphasis is not placed on Q values in high-frequency regions, however, a soft magnetic alloy powder having a large variation can be used. When a soft magnetic alloy powder having a large variation is used, cost can be reduced due to comparatively inexpensive manufacture thereof.

EXAMPLES

Hereinafter, the present invention will be described based on Examples.

Experiment 1: Sample No. 1 to Sample No. 26

Pure metal materials were respectively weighed so that a base alloy having a composition of Fe: 73.5 atom %, Si: 13.5 atom %, B: 9.0 atom %, Nb: 3.0 atom %, and Cu: 1.0 atom % was obtained. Then, the base alloy was manufactured by evacuating a chamber and thereafter melting the pure metal materials by high-frequency heating.

Then, the prepared base alloy was heated and molten to be turned into a metal in a molten state at 1300° C. This metal was thereafter sprayed against a roll by a single roll method at a predetermined temperature and a predetermined vapor pressure, and ribbons were prepared. These ribbons were configured to have a thickness of 20 μm by appropriately adjusting a rotation speed of the roll. Next, each of the prepared ribbons underwent a heat treatment, and single-plate samples were obtained.

In Experiment 1, each sample shown in Table 1 was manufactured by changing roll temperature, vapor pressure, and heat treatment conditions. The vapor pressure was adjusted using an Ar gas whose dew point had been adjusted.

Each of the ribbons before the heat treatment underwent an X-ray diffraction measurement for confirmation of existence of crystals. In addition, existence of microcrystals was confirmed by observing a restricted visual field diffraction image and a bright field image at 300,000 magnifications using a transmission electron microscope. As a result, it was confirmed that the ribbons of each example had no crystals or microcrystals and were amorphous.

Then, each sample after each ribbon underwent the heat treatment was measured with respect to coercivity, permeability at 1 kHz frequency, and permeability at 1 MHz frequency. Table 1 shows the results. A permeability of $9.0\times10^4$ or more at 1 kHz frequency was considered to be favorable. A permeability of $2.3\times10^3$ or more at 1 MHz frequency was considered to be favorable.

Moreover, each sample was measured using a three-dimensional atom probe (3DAP) with respect to virtual-line total distance, virtual-line average distance, and virtual-line standard deviation. Moreover, an existence ratio of virtual lines having a length of 4 to 16 nm and a volume ratio of a Fe network composition phase were measured. Table 1 shows the results. Incidentally, samples expressing "<1" in columns of virtual-line total distance are samples having no virtual lines between a Fe maximum point and a Fe maximum point. When a Fe maximum point and a Fe maximum point are adjacent each other, however, an extremely short virtual line may be considered to exist between the two adjacent Fe maximum points at the time of calculation of virtual-line total distance. In this case, the virtual-line total distance may be considered to be 0.0001 mm/μm$^3$. In the present application, "<1" is thus written in the columns of virtual-line total distance as a description including a virtual-line total distance of 0 mm/μm$^3$ and a virtual-line total distance of 0.0001 mm/μm$^3$. Incidentally, such an extremely short virtual line was considered to fail to exist at the time of calculation of virtual-line average distance and/or virtual-line standard deviation.

TABLE 1

| | | | | | Heat treatment | | Network structures | |
|---|---|---|---|---|---|---|---|---|
| SAMPLE NO. | Example or Comparative Example | Roll temperature (° C.) | Vapor pressure in chamber (hPa) | Existence of crystals before heat treatment | Heat treatment temperature (° C.) | Heat treatment time (h) | Virtual-line total distance (mm/μm$^3$) | Virtual-line average distance (nm) |
| 1 | Comp. Ex. | 70 | 25 | micro | 550 | 1 | <1 | — |
| 2 | Comp. Ex. | 70 | 18 | amorphous | 550 | 1 | <1 | — |
| 3 | Ex. | 70 | 11 | amorphous | 550 | 1 | 11 | 8 |
| 4 | Ex. | 70 | 4 | amorphous | 550 | 1 | 14 | 9 |
| 5 | Ex. | 70 | Ar filling | amorphous | 550 | 1 | 13 | 9 |
| 6 | Ex. | 70 | vacuum | amorphous | 550 | 1 | 15 | 8 |
| 7 | Comp. Ex. | 70 | 4 | amorphous | 550 | 0.1 | 7 | 6 |
| 8 | Ex. | 70 | 4 | amorphous | 550 | 0.5 | 13 | 7 |
| 9 | Ex. | 70 | 4 | amorphous | 550 | 10 | 12 | 10 |
| 10 | Comp. Ex. | 70 | 4 | amorphous | 550 | 100 | 2 | 5 |
| 11 | Comp. Ex. | 70 | 4 | amorphous | 450 | 1 | <1 | — |
| 12 | Ex. | 70 | 4 | amorphous | 500 | 1 | 12 | 7 |
| 13 | Ex. | 70 | 4 | amorphous | 550 | 1 | 14 | 9 |
| 14 | Ex. | 70 | 4 | amorphous | 600 | 1 | 12 | 11 |
| 15 | Comp. Ex. | 70 | 4 | amorphous | 650 | 1 | 15 | 13 |
| 16 | Comp. Ex. | 50 | 25 | micro | 550 | 1 | <1 | — |
| 17 | Comp. Ex. | 50 | 18 | amorphous | 550 | 1 | 4 | 4 |
| 18 | Ex. | 50 | 11 | amorphous | 550 | 1 | 10 | 10 |
| 19 | Ex. | 50 | 4 | amorphous | 550 | 1 | 14 | 8 |
| 20 | Ex. | 50 | Ar filling | amorphous | 550 | 1 | 13 | 8 |
| 21 | Ex. | 50 | vacuum | amorphous | 550 | 1 | 14 | 9 |
| 22 | Comp. Ex. | 30 | 25 | amorphous | 550 | 1 | <1 | — |
| 23 | Comp. Ex. | 30 | 11 | amorphous | 550 | 1 | <1 | — |
| 24 | Comp. Ex. | 30 | 4 | amorphous | 550 | 1 | <1 | — |
| 25 | Comp. Ex. | 30 | Ar filling | amorphous | 550 | 1 | <1 | — |
| 26 | Comp. Ex. | 30 | vacuum | amorphous | 550 | 1 | <1 | — |

| | Network structures | | | | | |
|---|---|---|---|---|---|---|
| SAMPLE NO. | Virtual-line standard deviation (nm) | Existence ratio of 4 to 16 nm virtual lines (%) | Fe composition network phase (vol %) | Coercivity (A/m) | μr (1 kHz) | μr (1 MHz) |
| 1 | — | — | — | 7.03 | 6200 | 730 |
| 2 | — | — | — | 1.86 | 63000 | 1900 |
| 3 | 3.6 | 88 | 35 | 0.96 | 103000 | 2700 |
| 4 | 3.6 | 91 | 36 | 0.85 | 118000 | 2800 |
| 5 | 3.8 | 89 | 36 | 0.79 | 110000 | 2670 |
| 6 | 3.4 | 91 | 35 | 0.73 | 108000 | 2560 |

TABLE 1-continued

| | | | | | | |
|---|---|---|---|---|---|---|
| 7 | 3.4 | 77 | 18 | 1.23 | 52000 | 1800 |
| 8 | 3.2 | 85 | 31 | 0.82 | 108000 | 2730 |
| 9 | 3.8 | 91 | 41 | 0.92 | 103000 | 2570 |
| 10 | 2.9 | 55 | 54 | 1.25 | 68000 | 1800 |
| 11 | — | — | — | 1.40 | 40000 | 1500 |
| 12 | 3.2 | 82 | 31 | 0.82 | 108000 | 2730 |
| 13 | 4 | 85 | 37 | 0.86 | 107000 | 2580 |
| 14 | 4.6 | 88 | 41 | 0.94 | 101000 | 2570 |
| 15 | 7.1 | 75 | 52 | 48 | 2000 | 450 |
| 16 | — | — | — | 6.03 | 7200 | 800 |
| 17 | 2.5 | 40 | 20 | 1.53 | 55000 | 1840 |
| 18 | 4.1 | 88 | 36 | 0.95 | 113000 | 2650 |
| 19 | 3.4 | 90 | 37 | 0.89 | 110000 | 2680 |
| 20 | 3.3 | 92 | 36 | 0.86 | 114000 | 2590 |
| 21 | 3.8 | 90 | 35 | 0.80 | 115000 | 2810 |
| 22 | — | — | — | 1.73 | 64000 | 2210 |
| 23 | — | — | — | 1.83 | 54000 | 2100 |
| 24 | — | — | — | 1.65 | 70000 | 2200 |
| 25 | — | — | — | 1.67 | 55000 | 210 |
| 26 | — | — | — | 1.59 | 63000 | 2000 |

Table 1 shows that amorphous ribbons are obtained in Examples where roll temperature was 50 to 70° C., vapor pressure was controlled to 11 hPa or less in a chamber of 30° C., and heat conditions were 500 to 600° C. and 0.5 to 10 hours. Then, it was confirmed that a favorable Fe network can be formed by carrying out a heat treatment against the ribbons. It was also confirmed that coercivity decreased and permeability improved.

On the other hand, there was a tendency that virtual-line total distance and/or virtual-line average distance to be condition(s) of a favorable Fe network phase after a heat treatment was/were out of predetermined range(s) or no virtual lines were observed in comparative examples whose roll temperature was 30° C. (Sample No. 22 to Sample No. 26) or comparative examples whose roll temperature was 50° C. or 70° C. and vapor pressure was higher than 11 hPa (Sample No. 1, Sample No. 2, Sample No. 16, and Sample No. 17). That is, when the roll temperature was too low and the vapor pressure was too high at the time of manufacture of the ribbons, a favorable Fe network could not be formed after the ribbons underwent a heat treatment.

When the heat treatment temperature was too low (Sample No. 11) and the heat treatment time was too short (Sample No. 7), a favorable Fe network was not formed, and coercivity was higher and permeability was lower than those of Examples. When the heat treatment temperature was high (Sample No. 15) and the heat treatment time was too long (Sample No. 10), the number of maximum points of Fe tended to decrease, and a virtual-line total distance and a virtual-line average distance tended to be small. Sample No. 15 had a tendency that when the heat treatment temperature was high, coercivity deteriorated rapidly, and permeability decreased rapidly. It is conceived that this is because a part of the soft magnetic alloy forms boride ($Fe_2B$). The formation of boride in Sample No. 15 was confirmed using an X-ray diffraction measurement.

Experiment 2

An experiment was carried out in the same manner as Experiment 1 by changing a composition of a base alloy at a roll temperature of 70° C. and a vapor pressure of 4 hPa in a chamber. Each sample underwent a heat treatment at 450° C., 500° C., 550° C., 600° C., and 650° C., and a temperature when coercivity was lowest was determined as a heat treatment temperature. Table 2 and Table 3 show characteristics at the temperature when coercivity was lowest. That is, the samples had different heat treatment temperatures. Table 2 shows the results of experiments carried out with Fe—Si-M-B—Cu—C based compositions. Table 3 and Table 4 show the results of experiments carried out with Fe-M'-B—C based compositions. Table 5 and Table 6 show the results of experiments carried out with Fe-M"-B—P—C based compositions. Table 7 shows the results of experiments carried out with Fe—Si—P—B—Cu—C based compositions.

In the Fe—Si-M-B—Cu—C based compositions, the above-mentioned favorable Fe network was formed, a coercivity of 2.0 A/m or less was considered to be favorable, a permeability of $5.0\times10^4$ or more at 1 kHz frequency was considered to be favorable, and a permeability of $2.0\times10^3$ or more at 1 MHz frequency was considered to be favorable. In the Fe-M'-B—C based compositions, a coercivity of 20 A/m or less was considered to be favorable, a permeability of $2.0\times10^4$ or more at 1 kHz frequency was considered to be favorable, and a permeability of $1.3\times10^3$ or more at 1 MHz frequency was considered to be favorable. In the Fe-M"-B—P—C based compositions, a coercivity of 4.0 A/m or less was considered to be favorable, a permeability of $5.0\times10^4$ or more at 1 kHz frequency was considered to be favorable, and a permeability of $2.0\times10^3$ or more at 1 MHz frequency was considered to be favorable. In the Fe—Si—P—B—Cu—C based compositions, a coercivity of 7.0 A/m or less was considered to be favorable, a permeability of $3.0\times10^4$ or more at 1 kHz frequency was considered to be favorable, and a permeability of $2.0\times10^3$ or more at 1 MHz frequency was considered to be favorable.

Sample No. 39 was observed using a 3DAP with 5 nm thickness. FIG. 1 shows the results. FIG. 1 shows that a part having a high Fe content is distributed in network in Example of Sample No. 39.

TABLE 2

| SAMPLE NO. | EXAMPLE OR COMPARATIVE EXAMPLE | Composition | Existence of crystals before heat treatment | Network structures: Virtual-line total distance (mm/μm$^3$) | Network structures: Virtual-line average distance (nm) |
|---|---|---|---|---|---|
| 27 | Comp. Ex. | Fe77.5Cu1Nb3Si13.5B5 | micro crystalline | <1 | — |
| 28 | Ex. | Fe75.5Cu1Nb3Si13.5B7 | amorphous | 17 | 7 |
| 29 | Ex. | Fe73.5Cu1Nb3Si13.5B9 | amorphous | 14 | 9 |
| 30 | Ex. | Fe71.5Cu1Nb3Si13.5B11 | amorphous | 12 | 7 |
| 31 | Ex. | Fe69.5Cu1Nb3Si13.5B13 | amorphous | 11 | 6 |
| 32 | Comp. Ex. | Fe74.5Nb3Si13.5B9 | micro crystalline | <1 | — |
| 33 | Ex. | Fe74.4Cu0.1Nb3Si13.5B9 | amorphous | 10 | 6 |
| 34 | Ex. | Fe73.5Cu1Nb3Si13.5B9 | amorphous | 13 | 10 |
| 35 | Ex. | Fe71.5Cu3Nb3Si13.5B9 | amorphous | 12 | 9 |
| 36 | Comp. Ex. | Fe71Cu3.5Nb3Si13.5B9 | crystalline | No ribbon was manufactured | |
| 37 | Comp. Ex. | Fe79.5Cu1Nb3Si9.5B9 | micro crystalline | <1 | — |
| 38 | Ex. | Fe75.5Cu1Nb3Si11.5B9 | amorphous | 16 | 7 |
| 39 | Ex. | Fe73.5Cu1Nb3Si13.5B9 | amorphous | 14 | 8 |
| 40 | Ex. | Fe73.5Cu1Nb3Si15.5B7 | amorphous | 13 | 8 |
| 41 | Ex. | Fe71.5Cu1Nb3Si15.5B9 | amorphous | 13 | 10 |
| 42 | Ex. | Fe69.5Cu1Nb3Si17.5B9 | amorphous | 11 | 12 |
| 43 | Comp. Ex. | Fe76.5Cu1Si13.5B9 | crystalline | <1 | — |
| 44 | Ex. | Fe75.5Cu1Nb1Si13.5B9 | amorphous | 10 | 6 |
| 45 | Ex. | Fe73.5Cu1Nb3Si13.5B9 | amorphous | 13 | 9 |
| 46 | Ex. | Fe71.5Cu1Nb5Si13.5B9 | amorphous | 14 | 8 |
| 47 | Ex. | Fe66.5Cu1Nb10Si13.5B9 | amorphous | 11 | 8 |
| 48 | Ex. | Fe73.5Cu1Ti3Si13.5B9 | amorphous | 13 | 7 |
| 49 | Ex. | Fe73.5Cu1Zr3Si13.5B9 | amorphous | 10 | 7 |
| 50 | Ex. | Fe73.5Cu1Hf3Si13.5B9 | amorphous | 11 | 7 |
| 51 | Ex. | Fe73.5Cu1V3Si13.5B9 | amorphous | 12 | 7 |
| 52 | Ex. | Fe73.5Cu1Ta3Si13.5B9 | amorphous | 11 | 8 |
| 53 | Ex. | Fe73.5Cu1Mo3Si13.5B9 | amorphous | 10 | 7 |
| 54 | Ex. | Fe73.5Cu1Hf1.5Nb1.5Si13.5B9 | amorphous | 16 | 9 |
| 55 | Ex. | Fe79.5Cu1Nb2Si9.5B9C1 | amorphous | 10 | 6 |
| 56 | Ex. | Fe79Cu1Nb2Si9B5C4 | amorphous | 10 | 6 |
| 57 | Ex. | Fe73.5Cu1Nb3Si13.5B8C1 | amorphous | 13 | 9 |
| 58 | Ex. | Fe73.5Cu1Nb3Si13.5B5C4 | amorphous | 12 | 7 |
| 59 | Ex. | Fe69.5Cu1Nb3Si17.5B8C1 | amorphous | 11 | 6 |
| 60 | Ex. | Fe69.5Cu1Nb3Si17.5B5C4 | amorphous | 12 | 6 |

| SAMPLE NO. | Network structures: Virtual-line standard deviation (nm) | Network structures: Existence ratio of 4 to 16 nm virtual lines (%) | Network structures: Fe composition network phase (vol %) | Coercivity (A/m) | μr (1 kHz) | μr (1 MHz) |
|---|---|---|---|---|---|---|
| 27 | — | — | — | 9 | 5400 | 640 |
| 28 | 3.1 | 87 | 45 | 1.17 | 93000 | 2560 |
| 29 | 3.6 | 90 | 36 | 0.85 | 118000 | 2800 |
| 30 | 3.0 | 91 | 32 | 0.84 | 103000 | 2620 |
| 31 | 3.2 | 84 | 33 | 0.94 | 97000 | 2540 |
| 32 | — | — | — | 14 | 3500 | 400 |
| 33 | 3.6 | 82 | 25 | 1.33 | 55000 | 2550 |
| 34 | 4.2 | 87 | 36 | 0.85 | 118000 | 2800 |
| 35 | 3.9 | 89 | 33 | 1.17 | 75000 | 2320 |
| 36 | No ribbon was manufactured | | | | | |
| 37 | — | — | — | 24 | 2000 | 440 |
| 38 | 3.6 | 83 | 34 | 1.04 | 92000 | 2450 |
| 39 | 3.9 | 85 | 36 | 0.85 | 118000 | 2800 |
| 40 | 3.7 | 88 | 36 | 0.78 | 118000 | 2840 |
| 41 | 4.2 | 87 | 40 | 0.79 | 120000 | 2730 |
| 42 | 5.1 | 82 | 49 | 0.89 | 100200 | 2360 |
| 43 | — | — | — | 2800 | 1500 | 250 |
| 44 | 3.7 | 82 | 24 | 1.32 | 73000 | 2540 |
| 45 | 4.0 | 88 | 36 | 0.85 | 118000 | 2800 |
| 46 | 3.6 | 90 | 34 | 0.95 | 110000 | 2740 |
| 47 | 4.0 | 84 | 38 | 1.03 | 98000 | 2600 |
| 48 | 3.3 | 86 | 31 | 1.39 | 51000 | 2320 |
| 49 | 3.3 | 88 | 27 | 1.45 | 53000 | 2310 |
| 50 | 3.4 | 88 | 29 | 1.4 | 54000 | 2350 |
| 51 | 3.3 | 88 | 29 | 1.32 | 55000 | 2250 |
| 52 | 3.4 | 91 | 25 | 1.52 | 50000 | 2320 |
| 53 | 3.2 | 87 | 23 | 1.32 | 68000 | 2480 |
| 54 | 4.2 | 83 | 34 | 1.34 | 78000 | 2640 |
| 55 | 3.8 | 80 | 22 | 1.47 | 52000 | 2350 |
| 56 | 3.7 | 81 | 25 | 1.43 | 56000 | 2270 |

TABLE 2-continued

| | | | | | | |
|---|---|---|---|---|---|---|
| 57 | 4.1 | 87 | 37 | 0.77 | 121000 | 2830 |
| 58 | 3.0 | 91 | 33 | 1.01 | 98000 | 2550 |
| 59 | 3.7 | 81 | 33 | 1.21 | 89000 | 2460 |
| 60 | 3.7 | 81 | 35 | 1.31 | 71000 | 2300 |

TABLE 3

| SAMPLE NO. | Example or Comparative Example | Composition | State before heat treatment (amorphous or crystalline) | Network structures: Virtual-line total distance (mm/μm$^3$) | Network structures: Virtual-line average distance (nm) |
|---|---|---|---|---|---|
| 61 | Comp. Ex. | Fe88Nb3B9 | crystalline | <1 | — |
| 62 | Ex. | Fe86Nb5B9 | amorphous | 17 | 8 |
| 63 | Ex. | Fe84Nb7B9 | amorphous | 20 | 8 |
| 64 | Ex. | Fe81Nb10B9 | amorphous | 21 | 9 |
| 65 | Ex. | Fe77Nb14B9 | amorphous | 21 | 9 |
| 66 | Comp. Ex. | Fe90Nb7B3 | crystalline | <1 | — |
| 67 | Ex. | Fe87Nb7B6 | amorphous | 15 | 7 |
| 68 | Ex. | Fe84Nb7B9 | amorphous | 20 | 7 |
| 69 | Ex. | Fe81Nb7B12 | amorphous | 16 | 8 |
| 70 | Ex. | Fe75Nb7B18 | amorphous | 16 | 9 |
| 71 | Ex. | Fe84Nb7B9 | amorphous | 19 | 8 |
| 72 | Ex. | Fe83.9Cu0.1Nb7B9 | amorphous | 21 | 6 |
| 73 | Ex. | Fe83Cu2Nb7B9 | amorphous | 23 | 6 |
| 74 | Comp. Ex. | Fe81Cu3Nb7B9 | crystalline | <1 | — |
| 75 | Comp. Ex. | Fe85.9Cu0.1Nb5B9 | micro crystalline | 4 | 5 |
| 76 | Ex. | Fe83.9Cu0.1Nb7B9 | amorphous | 22 | 7 |
| 77 | Ex. | Fe80.9Cu0.1Nb10B9 | amorphous | 23 | 6 |
| 78 | Ex. | Fe76.9Cu0.1Nb14B9 | amorphous | 25 | 7 |
| 79 | Comp. Ex. | Fe89.9Cu0.1Nb7B3 | micro crystalline | 6 | 6 |
| 80 | Ex. | Fe88.4Cu0.1Nb7B4.5 | amorphous | 21 | 6 |
| 81 | Ex. | Fe83.9Cu0.1Nb7B9 | amorphous | 20 | 7 |
| 82 | Ex. | Fe80.9Cu0.1Nb7B12 | amorphous | 20 | 7 |
| 83 | Ex. | Fe74.9Cu0.1Nb7B18 | amorphous | 24 | 6 |
| 84 | Ex. | Fe91Zr7B2 | amorphous | 20 | 8 |
| 85 | Ex. | Fe90Zr7B3 | amorphous | 19 | 8 |
| 86 | Ex. | Fe89Zr7B3Cu1 | amorphous | 19 | 7 |
| 87 | Ex. | Fe90Hf7B3 | amorphous | 20 | 7 |
| 88 | Ex. | Fe89Hf7B4 | amorphous | 19 | 8 |
| 89 | Ex. | Fe88Hf7B3Cu1 | amorphous | 21 | 6 |
| 90 | Ex. | Fe84Nb3.5Zr3.5B8Cu1 | amorphous | 20 | 7 |
| 91 | Ex. | Fe84Nb3.5Hf3.5B8Cu1 | amorphous | 20 | 7 |
| 92 | Ex. | Fe90.9Nb6B3C0.1 | amorphous | 18 | 7 |
| 93 | Ex. | Fe93.06Nb2.97B2.97C1 | amorphous | 23 | 7 |
| 94 | Ex. | Fe94.05Nb1.98B2.97C1 | amorphous | 12 | 7 |
| 95 | Ex. | Fe90.9Nb1.98B2.97C4 | amorphous | 12 | 8 |
| 96 | Ex. | Fe90.9Nb3B6C0.1 | amorphous | 16 | 7 |
| 97 | Ex. | Fe94.5Nb3B2C0.5 | amorphous | 14 | 8 |
| 98 | Ex. | Fe83.9Nb7B9C0.1 | amorphous | 22 | 6 |
| 99 | Ex. | Fe80.8Nb6.7B8.65C3.85 | amorphous | 23 | 6 |
| 100 | Ex. | Fe77.9Nb14B8C0.1 | amorphous | 24 | 6 |
| 101 | Ex. | Fe75Nb13.5B7.5C4 | amorphous | 15 | 7 |
| 102 | Ex. | Fe78Nb1B17C4 | amorphous | 12 | 7 |
| 103 | Ex. | Fe78Nb1B20C1 | amorphous | 22 | 7 |

| SAMPLE NO. | Network structures: Virtual-line standard deviation (nm) | Network structures: Existence ratio of 4 to 16 nm virtual lines (%) | Network structures: Fe composition network phase (vol %) | Coercivity (A/m) | μr (1 kHz) | μr (1 MHz) |
|---|---|---|---|---|---|---|
| 61 | — | — | — | 15000 | 900 | 300 |
| 62 | 4.0 | 84 | 38 | 12.3 | 25000 | 1800 |
| 63 | 3.4 | 92 | 37 | 5.5 | 43000 | 2200 |
| 64 | 4.0 | 88 | 39 | 5.4 | 52000 | 2150 |
| 65 | 4.2 | 86 | 36 | 4.8 | 55000 | 2180 |
| 66 | — | — | — | 20000 | 2100 | 600 |
| 67 | 3.9 | 81 | 29 | 9.5 | 35000 | 1600 |
| 68 | 3.3 | 90 | 37 | 5.5 | 43000 | 2200 |
| 69 | 3.7 | 87 | 34 | 4.9 | 45000 | 2100 |

TABLE 3-continued

| | | | | | | |
|---|---|---|---|---|---|---|
| 70 | 4.2 | 85 | 31 | 3.9 | 58000 | 1930 |
| 71 | 3.8 | 85 | 37 | 5.5 | 43000 | 2100 |
| 72 | 2.8 | 84 | 36 | 3.9 | 59000 | 2200 |
| 73 | 2.7 | 85 | 39 | 3.7 | 60000 | 2350 |
| 74 | — | — | — | 18000 | 2100 | 650 |
| 75 | 3.0 | 51 | — | 25 | 10000 | 1300 |
| 76 | 3.6 | 83 | 36 | 3.9 | 59000 | 2200 |
| 77 | 2.9 | 82 | 39 | 3.7 | 65000 | 1800 |
| 78 | 4.0 | 80 | 47 | 4.8 | 37000 | 1840 |
| 79 | 3.9 | 67 | — | 16000 | 1800 | 560 |
| 80 | 2.6 | 85 | 36 | 9.9 | 48000 | 1950 |
| 81 | 3.5 | 87 | 36 | 3.9 | 59000 | 2200 |
| 82 | 3.7 | 83 | 32 | 6.3 | 38000 | 1930 |
| 83 | 3.0 | 81 | 45 | 7.8 | 25000 | 1880 |
| 84 | 3.5 | 88 | 37 | 6.8 | 23000 | 1500 |
| 85 | 3.1 | 94 | 35 | 3.7 | 42000 | 1890 |
| 86 | 3.4 | 89 | 36 | 4.1 | 49000 | 2010 |
| 87 | 3.5 | 86 | 36 | 5.1 | 38000 | 1840 |
| 88 | 3.3 | 90 | 35 | 3.9 | 45000 | 1930 |
| 89 | 2.9 | 83 | 38 | 2.7 | 60000 | 2160 |
| 90 | 3.5 | 85 | 35 | 1.4 | 110000 | 2790 |
| 91 | 3.5 | 85 | 35 | 1.1 | 100000 | 2570 |
| 92 | 3.9 | 81 | 36 | 5.9 | 24000 | 1300 |
| 93 | 3.6 | 82 | 37 | 4.8 | 30000 | 1600 |
| 94 | 3.4 | 90 | 37 | 4.9 | 56000 | 2100 |
| 95 | 3.6 | 87 | 35 | 3.1 | 64000 | 2300 |
| 96 | 3.7 | 82 | 34 | 5.8 | 28000 | 1400 |
| 97 | 3.9 | 84 | 38 | 4.8 | 23000 | 1380 |
| 98 | 3.0 | 81 | 39 | 3.6 | 42000 | 1860 |
| 99 | 2.9 | 82 | 40 | 2.8 | 79000 | 2300 |
| 100 | 3.0 | 80 | 32 | 7.6 | 23000 | 1700 |
| 101 | 3.7 | 82 | 39 | 3.2 | 64000 | 2130 |
| 102 | 3.4 | 89 | 41 | 11.2 | 34000 | 1400 |
| 103 | 3.6 | 83 | 44 | 10.3 | 23000 | 1390 |

TABLE 4

| | | | | Network structures | |
|---|---|---|---|---|---|
| SAMPLE NO. | Example or Comparative Example | Composition | State before heat treatment (amorphous or crystalline) | Virtual-line total distance (mm/μm$^3$) | Virtual-line average distance (nm) |
| 104 | Ex. | Fe86.6Nb3.2B10Cu0.1C0.1 | amorphous | 21 | 6 |
| 105 | Ex. | Fe75.8Nb14B10Cu0.1C0.1 | amorphous | 18 | 7 |
| 106 | Ex. | Fe89.8Nb7B3Cu0.1C0.1 | amorphous | 20 | 7 |
| 107 | Ex. | Fe72.8Nb7B20Cu0.1C0.1 | amorphous | 17 | 7 |
| 108 | Ex. | Fe80.8Nb3.2B10Cu3C3 | amorphous | 19 | 6 |
| 109 | Ex. | Fe70NB14B10Cu3C3 | amorphous | 19 | 7 |
| 110 | Ex. | Fe84Nb7B3Cu3C3 | amorphous | 19 | 7 |
| 111 | Ex. | Fe67Nb7B20Cu3C3 | amorphous | 14 | 8 |
| 112 | Ex. | Fe85Nb3B10Cu1C1 | amorphous | 20 | 8 |
| 113 | Ex. | Fe84.8Nb3.2B10Cu1C1 | amorphous | 22 | 8 |
| 114 | Ex. | Fe83Nb5B10Cu1C1 | amorphous | 21 | 7 |
| 115 | Ex. | Fe81Nb7B10Cu1C1 | amorphous | 21 | 7 |
| 116 | Ex. | Fe78Nb10B10Cu1C1 | amorphous | 19 | 6 |
| 117 | Ex. | Fe76Nb12B10Cu1C1 | amorphous | 16 | 7 |
| 118 | Ex. | Fe74Nb14B10Cu1C1 | amorphous | 17 | 7 |
| 160 | Ex. | Fe75.8Nb14B10Cr0.1Cu0.1 | amorphous | 20 | 8 |
| 161 | Ex. | Fe82.8Nb7B10Cr0.1Cu0.1 | amorphous | 21 | 7 |
| 162 | Ex. | Fe86.8Nb3B10Cr0.1Cu0.1 | amorphous | 22 | 8 |
| 163 | Ex. | Fe72.8Nb7B20Cr0.1Cu0.1 | amorphous | 11 | 9 |
| 164 | Ex. | Fe89.8Nb7B3Cr0.1Cu0.1 | amorphous | 22 | 8 |
| 165 | Ex. | Fe73Nb14B10Cr1.5Cu1.5 | amorphous | 15 | 7 |
| 166 | Ex. | Fe80Nb7B10Cr1.5Cu1.5 | amorphous | 16 | 8 |
| 167 | Ex. | Fe84Nb3B10Cr1.5Cu1.5 | amorphous | 14 | 8 |
| 168 | Ex. | Fe70Nb7B20Cr1.5Cu1.5 | amorphous | 11 | 8 |
| 169 | Ex. | Fe87Nb7B3Cr1.5Cu1.5 | amorphous | 19 | 7 |
| 170 | Ex. | Fe72Nb11B14Cr1Cu2 | amorphous | 16 | 8 |
| 171 | Ex. | Fe73Nb10B14Cr1Cu2 | amorphous | 16 | 8 |
| 172 | Ex. | Fe90Nb5B3.5Cr0.5Cu1 | amorphous | 18 | 6 |
| 173 | Ex. | Fe91Nb4.5B3Cr0.5Cu1 | amorphous | 18 | 8 |
| 174 | Ex. | Fe74.5Nb14B10Cr0.5Cu1 | amorphous | 19 | 8 |
| 175 | Ex. | Fe76.5Nb12B10Cr0.5Cu1 | amorphous | 18 | 6 |
| 176 | Ex. | Fe78.5Nb10B10Cr0.5Cu1 | amorphous | 19 | 7 |
| 177 | Ex. | Fe81.5Nb7B10Cr0.5Cu1 | amorphous | 19 | 8 |

TABLE 4-continued

| | | | | | |
|---|---|---|---|---|---|
| 178 | Ex. | Fe83.5Nb5B10Cr0.5Cu1 | amorphous | 20 | 8 |
| 179 | Ex. | Fe85.5Nb3B10Cr0.5Cu1 | amorphous | 19 | 7 |

| | Network structures | | | | | |
|---|---|---|---|---|---|---|
| SAMPLE NO. | Virtual-line standard deviation (nm) | Existence ratio of 4 to 16 nm virtual lines (%) | Fe composition network phase (vol %) | Coercivity (A/m) | μr (1 kHz) | μr (1 MHz) |
| 104 | 3.2 | 84 | 35 | 1.1 | 98000 | 2540 |
| 105 | 3.3 | 82 | 36 | 1.3 | 92000 | 2560 |
| 106 | 3.5 | 82 | 43 | 1.0 | 102000 | 2870 |
| 107 | 3.4 | 84 | 35 | 1.4 | 90200 | 2490 |
| 108 | 3.3 | 90 | 32 | 1.5 | 85700 | 2540 |
| 109 | 3.2 | 94 | 31 | 1.6 | 86300 | 2460 |
| 110 | 3.5 | 84 | 37 | 1.5 | 85700 | 2440 |
| 111 | 3.4 | 93 | 26 | 1.7 | 81700 | 2310 |
| 112 | 3.6 | 78 | 44 | 2.1 | 74400 | 2050 |
| 113 | 3.5 | 95 | 39 | 1.0 | 101200 | 2870 |
| 114 | 3.7 | 94 | 38 | 1.1 | 98100 | 2910 |
| 115 | 3.4 | 93 | 39 | 1.1 | 98180 | 2830 |
| 116 | 3.2 | 93 | 37 | 1.2 | 95300 | 2730 |
| 117 | 3.3 | 84 | 35 | 1.4 | 90200 | 2450 |
| 118 | 4.3 | 78 | 36 | 1.4 | 90000 | 2200 |
| 160 | 4.2 | 94 | 27 | 2.3 | 64500 | 2310 |
| 161 | 4.1 | 93 | 36 | 2.0 | 53000 | 2350 |
| 162 | 3.1 | 92 | 36 | 2.0 | 52300 | 2360 |
| 163 | 3.5 | 91 | 28 | 2.4 | 69200 | 2100 |
| 164 | 3.2 | 94 | 38 | 1.9 | 64590 | 2370 |
| 165 | 4.2 | 77 | 32 | 2.3 | 43500 | 2250 |
| 166 | 3.5 | 92 | 34 | 2.1 | 56300 | 2300 |
| 167 | 3.6 | 74 | 34 | 2.1 | 54300 | 2100 |
| 168 | 3.1 | 93 | 32 | 2.5 | 53200 | 2320 |
| 169 | 3.5 | 72 | 44 | 2.0 | 54200 | 2100 |
| 170 | 3.5 | 71 | 44 | 2.6 | 32400 | 2030 |
| 171 | 3.2 | 78 | 41 | 2.1 | 52300 | 2250 |
| 172 | 3.5 | 82 | 38 | 2.1 | 56300 | 2390 |
| 173 | 3.6 | 82 | 41 | 2.5 | 48300 | 2110 |
| 174 | 3.2 | 89 | 38 | 2.2 | 55000 | 2320 |
| 175 | 3.2 | 85 | 34 | 1.9 | 58300 | 2370 |
| 176 | 3.1 | 83 | 32 | 1.9 | 58200 | 2380 |
| 177 | 3.4 | 84 | 33 | 1.8 | 59800 | 2390 |
| 178 | 3.4 | 85 | 31 | 1.8 | 61000 | 2320 |
| 179 | 3.6 | 88 | 34 | 1.8 | 59300 | 2310 |

TABLE 5

| | | | | Network structures | |
|---|---|---|---|---|---|
| Sample No. | Example or Comparative Example | Composition | State before heat treatment (amorphous or crystalline) | Virtual-line total distance (mm/μm$^3$) | Virtual-line average distance (nm) |
| 120 | Ex. | Fe82.9Nb7B10P0.1 | amorphous | 19 | 7 |
| 121 | Ex. | Fe82.5Nb7B10P0.5 | amorphous | 14 | 8 |
| 122 | Ex. | Fe82Nb7B10P1 | amorphous | 20 | 7 |
| 123 | Ex. | Fe79Nb7B10P2 | amorphous | 16 | 7 |
| 124 | Ex. | Fe81Nb7B10P3Cu1C1 | amorphous | 19 | 8 |
| 125 | Comp. Ex. | Fe79.5Nb7B10P3.5 | amorphous | 15 | 4 |
| 126 | Ex. | Fe93.7Nb3.2B3P0.1 | amorphous | 21 | 6 |
| 127 | Ex. | Fe74.9Nb12B13P0.1 | amorphous | 16 | 7 |
| 128 | Ex. | Fe91Nb3.2B13P3 | amorphous | 19 | 6 |
| 129 | Ex. | Fe73Nb14B10P3 | amorphous | 15 | 7 |
| 130 | Ex. | Fe81.9Nb7B10P0.1C1 | amorphous | 22 | 8 |
| 131 | Ex. | Fe81.5Nb7B10P0.5C1 | amorphous | 21 | 6 |
| 131' | Ex. | Fe81.5Zr7B10P0.5C1 | amorphous | 21 | 6 |
| 131" | Ex. | Fe81.5Hf7B10P0.5C1 | amorphous | 22 | 6 |
| 132 | Ex. | Fe81Nb7B10P1C1 | amorphous | 20 | 7 |
| 133 | Ex. | Fe80Nb7B10P2C1 | amorphous | 18 | 8 |
| 134 | Ex. | Fe79Nb7B10P3C1 | amorphous | 16 | 7 |
| 135 | Comp. Ex. | Fe78.5Nb7B10P3.5C1 | amorphous | 16 | 4 |
| 136 | Ex. | Fe93.8Nb3.2B2.8P0.1C0.1 | amorphous | 22 | 6 |
| 137 | Ex. | Fe72.9Nb12B13P0.1C2 | amorphous | 15 | 7 |
| 138 | Ex. | Fe90.9Nb3.2B13P3C0.1 | amorphous | 16 | 6 |

TABLE 5-continued

| | | | | | |
|---|---|---|---|---|---|
| 139 | Ex. | Fe70Nb14B10P3C2 | amorphous | 15 | 7 |
| 140 | Ex. | Fe80.9Nb7B10P0.1Cu1 | amorphous | 21 | 8 |
| 141 | Ex. | Fe81.5Nb7B10P0.5Cu1 | amorphous | 22 | 8 |
| 142 | Ex. | Fe81Nb7B10P1Cu1 | amorphous | 21 | 9 |
| 143 | Ex. | Fe80Nb7B10P2Cu1 | amorphous | 20 | 8 |
| 144 | Ex. | Fe79Nb7B10P3Cu1 | amorphous | 18 | 7 |
| 145 | Ex. | Fe78.5Nb7B10P3.5Cu1 | amorphous | 17 | 8 |
| 146 | Ex. | Fe93.8Nb3.2B2.8P0.1Cu0.1 | amorphous | 22 | 7 |
| 147 | Ex. | Fe73.4Nb12B13P0.1Cu1.5 | amorphous | 17 | 7 |
| 148 | Ex. | Fe90.9Nb3.2B13P3Cu0.1 | amorphous | 18 | 8 |
| 149 | Ex. | Fe70.5Nb14B10P3Cu1.5 | amorphous | 17 | 7 |
| 150 | Ex. | Fe80.9Nb7B10P0.1Cu1C1 | amorphous | 21 | 8 |
| 151 | Ex. | Fe80.5Nb7B10P0.5Cu1C1 | amorphous | 23 | 7 |
| 152 | Ex. | Fe80Nb7B10P1Cu1C1 | amorphous | 22 | 7 |
| 153 | Ex. | Fe79Nb7B10P2Cu1C1 | amorphous | 20 | 6 |
| 154 | Ex. | Fe78Nb7B10P3Cu1C1 | amorphous | 20 | 7 |
| 155 | Ex. | Fe77.5Nb7B10P3.5Cu1C1 | amorphous | 20 | 8 |
| 156 | Ex. | Fe93.7Nb3.2B2.8P0.1Cu0.1C0.1 | amorphous | 24 | 7 |
| 157 | Ex. | Fe71.4Nb12B13P0.1Cu1.5C2 | amorphous | 18 | 7 |
| 158 | Ex. | Fe90.8Nb3.2B2.8P3Cu0.1C0.1 | amorphous | 19 | 8 |
| 159 | Ex. | Fe68.5Nb12B13P3Cu1.5C2 | amorphous | 18 | 8 |

| | Network structures | | | | | |
|---|---|---|---|---|---|---|
| Sample No. | Virtual-line standard deviation (nm) | Existence ratio of 4 to 16 nm virtual lines (%) | Fe composition network phase (vol %) | Coercivity (A/m) | μr (1 kHz) | μr (1 MHz) |
| 120 | 3.2 | 85 | 38 | 1.2 | 94300 | 2600 |
| 121 | 4.2 | 85 | 33 | 1.2 | 94300 | 2530 |
| 122 | 3.2 | 83 | 34 | 1.3 | 91600 | 2500 |
| 123 | 3.5 | 84 | 36 | 1.4 | 89100 | 2420 |
| 124 | 3.8 | 83 | 37 | 1.6 | 84600 | 2390 |
| 125 | 2.1 | 32 | 38 | 2.1 | 74400 | 1890 |
| 126 | 3.2 | 92 | 47 | 1.0 | 79300 | 2340 |
| 127 | 3.5 | 84 | 33 | 1.3 | 91600 | 2510 |
| 128 | 4.3 | 91 | 45 | 1.5 | 74300 | 2340 |
| 129 | 3.9 | 77 | 33 | 1.6 | 84600 | 2200 |
| 130 | 3.8 | 94 | 37 | 1.1 | 98000 | 2540 |
| 131 | 4.4 | 95 | 38 | 1.1 | 98000 | 2840 |
| 131' | 4.3 | 94 | 37 | 1.2 | 97000 | 2750 |
| 131" | 4.4 | 93 | 36 | 1.3 | 96000 | 2700 |
| 132 | 4.2 | 91 | 36 | 1.2 | 95400 | 2520 |
| 133 | 3.6 | 89 | 38 | 1.3 | 92900 | 2500 |
| 134 | 3.5 | 78 | 42 | 1.4 | 88400 | 2250 |
| 135 | 2.1 | 31 | 43 | 1.9 | 78100 | 1840 |
| 136 | 3.4 | 95 | 47 | 0.9 | 82000 | 2600 |
| 137 | 3.1 | 84 | 33 | 1.2 | 95380 | 2520 |
| 138 | 3.4 | 83 | 45 | 1.3 | 81300 | 2480 |
| 139 | 3.6 | 78 | 33 | 1.4 | 88400 | 2200 |
| 140 | 4.2 | 93 | 43 | 1.3 | 90800 | 2400 |
| 141 | 4.2 | 92 | 38 | 1.3 | 90000 | 2830 |
| 142 | 4.5 | 91 | 37 | 1.4 | 88200 | 2660 |
| 143 | 3.2 | 95 | 36 | 1.5 | 85700 | 2550 |
| 144 | 3.3 | 85 | 35 | 1.7 | 81200 | 2530 |
| 145 | 3.5 | 79 | 38 | 2.3 | 71000 | 2300 |
| 146 | 3.6 | 93 | 48 | 1.1 | 74400 | 2240 |
| 147 | 3.7 | 76 | 38 | 1.4 | 88200 | 2450 |
| 148 | 3.2 | 81 | 44 | 1.6 | 83500 | 2320 |
| 149 | 3.5 | 82 | 38 | 1.7 | 81200 | 2430 |
| 150 | 3.5 | 94 | 43 | 1.2 | 95300 | 2300 |
| 151 | 3.6 | 95 | 38 | 1.2 | 95400 | 2630 |
| 152 | 3.5 | 92 | 37 | 1.3 | 92600 | 2500 |
| 153 | 3.8 | 91 | 36 | 1.4 | 90200 | 2480 |
| 154 | 3.1 | 90 | 35 | 1.5 | 85700 | 2460 |
| 155 | 3.1 | 90 | 26 | 1.6 | 84200 | 2210 |
| 156 | 3.6 | 94 | 35 | 1.0 | 83200 | 2850 |
| 157 | 4.3 | 89 | 36 | 1.3 | 92600 | 2500 |
| 158 | 3.4 | 84 | 39 | 1.4 | 87900 | 2460 |
| 159 | 3.6 | 79 | 27 | 1.5 | 85700 | 2200 |

TABLE 6

| Sample No. | Example or Comparative Example | Composition | State before heat treatment (amorphous or crystalline) | Network structures: Virtual-line total distance (mm/μm$^3$) | Network structures: Virtual-line average distance (nm) |
|---|---|---|---|---|---|
| 194 | Ex. | Fe81.4Nb7B10Cr0.5P0.1Cu1 | amorphous | 16 | 7 |
| 195 | Ex. | Fe81Nb7B10Cr0.5P0.5Cu1 | amorphous | 19 | 8 |
| 196 | Ex. | Fe80.5Nb7B10Cr0.5P1Cu1 | amorphous | 20 | 7 |
| 197 | Ex. | Fe79.5Nb7B10Cr0.5P2Cu1 | amorphous | 20 | 8 |
| 198 | Ex. | Fe78.5Nb7B10Cr0.5P3Cu1 | amorphous | 19 | 7 |
| 199 | Ex. | Fe78Nb7B10P3.5Cr0.5Cu1 | amorphous | 18 | 6 |
| 200 | Ex. | Fe93.7Nb3.2B2.8Cr0.1P0.1Cu0.1 | amorphous | 24 | 9 |
| 201 | Ex. | Fe71.9Nb12B13Cr1.5P0.1Cu1.5 | amorphous | 18 | 7 |
| 202 | Ex. | Fe90.8Nb3.2B2.8Cr0.1P3Cu0.1 | amorphous | 20 | 8 |
| 203 | Ex. | Fe69Nb12B13Cr1.5P3Cu1.5 | amorphous | 18 | 8 |
| 204 | Ex. | Fe80.4Nb7B10Cr0.5P0.1Cu1C1 | amorphous | 19 | 8 |
| 205 | Ex. | Fe80Nb7B10Cr0.5P0.5Cu1C1 | amorphous | 19 | 8 |
| 206 | Ex. | Fe79.5Nb7B10Cr0.5P1Cu1C1 | amorphous | 19 | 8 |
| 207 | Ex. | Fe78.5Nb7B10Cr0.5P2Cu1C1 | amorphous | 18 | 7 |
| 208 | Ex. | Fe77.5Nb7B10Cr0.5P3Cu1C1 | amorphous | 12 | 8 |
| 209 | Comp. Ex. | Fe77Nb7B10P3.5Cr0.5Cu1C1 | amorphous | 9 | 3 |
| 210 | Ex. | Fe93.6Nb3.2B2.8Cr0.1P0.1Cu0.1C0.1 | amorphous | 23 | 7 |
| 211 | Ex. | Fe69.9Nb12B13Cr1.5P0.1Cu1.5C2 | amorphous | 18 | 8 |
| 212 | Ex. | Fe90.7Nb3.2B2.8Cr0.1P3Cu0.1C0.1 | amorphous | 19 | 9 |
| 213 | Ex. | Fe67Nb12B13Cr1.5P3Cu1.5C2 | amorphous | 18 | 7 |

| Sample No. | Network structures: Virtual-line standard deviation (nm) | Network structures: Existence ratio of 4 to 16 nm virtual lines (%) | Network structures: Fe composition network phase (vol %) | Coercivity (A/m) | μr (1 kHz) | μr (1 MHz) |
|---|---|---|---|---|---|---|
| 194 | 3.4 | 85 | 37 | 1.4 | 73200 | 2340 |
| 195 | 3.4 | 86 | 38 | 1.4 | 73200 | 2450 |
| 196 | 3.6 | 91 | 37 | 1.5 | 78300 | 2470 |
| 197 | 3.8 | 90 | 36 | 1.6 | 74200 | 2340 |
| 198 | 3.5 | 91 | 33 | 1.8 | 73200 | 2350 |
| 199 | 3.1 | 79 | 33 | 3.8 | 51000 | 2100 |
| 200 | 3.5 | 82 | 35 | 1.2 | 83200 | 2640 |
| 201 | 3.4 | 93 | 36 | 1.5 | 76100 | 2450 |
| 202 | 3.5 | 95 | 39 | 1.7 | 71300 | 2460 |
| 203 | 3.5 | 72 | 25 | 1.8 | 79200 | 2120 |
| 204 | 3.5 | 93 | 38 | 1.3 | 82400 | 2500 |
| 205 | 3.1 | 94 | 37 | 1.3 | 85400 | 2500 |
| 206 | 3.8 | 93 | 36 | 1.4 | 89900 | 2480 |
| 207 | 3.4 | 94 | 35 | 1.5 | 87400 | 2460 |
| 208 | 3.5 | 92 | 32 | 1.7 | 82900 | 2420 |
| 209 | 2.1 | 43 | 25 | 3.5 | 48200 | 1350 |
| 210 | 3.6 | 98 | 35 | 1.1 | 89000 | 2840 |
| 211 | 3.7 | 94 | 36 | 1.4 | 89300 | 2430 |
| 212 | 4.1 | 93 | 39 | 1.6 | 85200 | 2340 |
| 213 | 3.5 | 92 | 27 | 1.7 | 83000 | 2230 |

TABLE 7

| Sample No. | Example or Comparative Example | Composition | State before heat treatment (amorphous or crystalline) | Network structures: Virtual-line total distance (mm/μm$^3$) | Network structures: Virtual-line average distance (nm) |
|---|---|---|---|---|---|
| 214 | Ex. | Fe86.9Cu0.1P1Si2B9C1 | amorphous | 18 | 7 |
| 215 | Ex. | Fe80.9Cu0.1P1Si8B9C1 | amorphous | 16 | 7 |
| 216 | Ex. | Fe82.9Cu0.1P2Si2B9C4 | amorphous | 16 | 8 |
| 217 | Ex. | Fe76.9Cu0.1P2Si8B9C4 | amorphous | 14 | 9 |
| 218 | Ex. | Fe83.3Si6B10Cu0.7 | amorphous | 16 | 8 |
| 219 | Ex. | Fe83.3Si4B10P2Cu0.7 | amorphous | 16 | 6 |
| 220 | Ex. | Fe83.3Si2B10P4Cu0.7 | amorphous | 16 | 7 |
| 221 | Ex. | Fe83.3B10P6Cu0.7 | amorphous | 16 | 6 |

TABLE 7-continued

| | | | | | |
|---|---|---|---|---|---|
| 222 | Ex. | Fe83.3Si3B5P8Cu0.7 | amorphous | 16 | 7 |
| 223 | Ex. | Fe83.3Si1B13P2Cu0.7 | amorphous | 16 | 6 |

| | Network structures | | | | | |
|---|---|---|---|---|---|---|
| Sample No. | Virtual-line standard deviation (nm) | Existence ratio of 4 to 16 nm virtual lines (%) | Fe composition network phase (vol %) | Coercivity (A/m) | μr (1 kHz) | μr (1 MHz) |
| 214 | 3.2 | 85 | 38 | 4.8 | 43000 | 2130 |
| 215 | 3.4 | 84 | 38 | 3.2 | 51200 | 2240 |
| 216 | 3.2 | 83 | 32 | 4.3 | 48300 | 2310 |
| 217 | 3.3 | 84 | 33 | 3.1 | 51200 | 2430 |
| 218 | 3.2 | 84 | 42 | 5.4 | 32400 | 2200 |
| 219 | 3.5 | 85 | 41 | 4.3 | 48300 | 2230 |
| 220 | 3.2 | 83 | 32 | 4.3 | 49300 | 2300 |
| 221 | 3.2 | 84 | 33 | 3.3 | 51000 | 2300 |
| 222 | 3.4 | 85 | 34 | 3.8 | 52000 | 2330 |
| 223 | 3.5 | 84 | 45 | 6.3 | 43200 | 2100 |

As shown in Table 2 and Table 3, a ribbon obtained by a single roll method at a roll temperature of 70° C. and a vapor pressure of 4 hPa can form an amorphous phase even if a base alloy has different compositions, and a heat treatment at an appropriate temperature forms a favorable Fe composition network phase, decreases coercivity, and improves permeability.

Examples having a Fe—Si-M-B—Cu—C based composition shown in Table 2 tended to have a comparatively small number of maximum points, and examples having a Fe-M'-B—C based composition shown in Table 3 and Table 4 tended to have a comparatively large number of maximum points. As a result, an example having a Fe-M'-B—C based composition tended to have a comparatively large virtual-line total distance.

In samples having a Fe—Si-M-B—Cu—C based composition shown in Table 2, particularly Sample No. 32 to Sample No. 36, the number of maximum points of Fe tended to increase by a small amount of addition of Cu. When a Cu content is too large, there is a tendency that a ribbon before a heat treatment obtained by a single roll method contains crystals, and a favorable Fe network is not formed.

In samples having a Fe—Si-M-B—Cu—C based composition shown in Table 2, particularly Sample No. 43 to Sample No. 47, a sample having a smaller Nb content shows that a ribbon obtained by a single roll method tended to easily contain crystals. When a Nb content is out of a range of 3 to 5 atom %, the virtual-line total distance tended to decrease and permeability tended to decrease easily, compared to when a Nb content is within the range of 3 to 5 atom %.

In samples having a Fe—Si-M-B—Cu—C based composition shown in Table 2, particularly Sample No. 27 to Sample No. 31, a sample having a smaller B content shows that a ribbon before a heat treatment obtained by a single roll method tended to easily contain microcrystals. A sample having a larger B content tended to easily have a decreased virtual-line total distance and a decreased permeability.

In samples having a Fe—Si-M-B—Cu—C based composition shown in Table 2, particularly Sample No. 37 to Sample No. 42, a sample having a smaller Si content tended to have a decreased permeability.

In samples having a Fe—Si-M-B—Cu—C based composition shown in Table 2, particularly Sample No. 55 and Sample No. 56, amorphousness tended to be maintained by containing C even in a range where a Fe content is increased, and a favorable Fe network tended to be formed.

In samples having a Fe-M'-B—C based composition shown in Table 3, particularly Sample No. 61 to Sample No. 65, a sample having a smaller M content shows that a ribbon before a heat treatment obtained by a single roll method tended to contain crystals.

In samples having a Fe-M'-B—C based composition shown in Table 3, particularly Sample No. 66 to Sample No. 70, a sample having a smaller B content shows that a ribbon before a heat treatment obtained by a single roll method tended to contain crystals, and a sample having a larger B content shows that virtual-line total distance tended to decrease.

As a result of similar examination with respect to Sample No. 71 to Sample No. 103 in Table 3 and Sample No. 104 to Sample No. 118 and Sample No. 160 to Sample No. 179 in Table 4, it was confirmed that an amorphous phase was formed in a soft magnetic alloy ribbon having an appropriate composition and manufactured at a roll temperature of 70° C. and a vapor pressure of 4 hPa in a chamber. Then, the samples tended to have a network structure of Fe, a low coercivity, and a high permeability by carrying out an appropriate heat treatment. Sample No. 104 to Sample No. 118, which contained 0.1 to 3.0 atom % of Cu and 0.1 to 3.0 atom % of C, tended to have a lower coercivity and a higher permeability, compared to the other samples.

Figure 9:
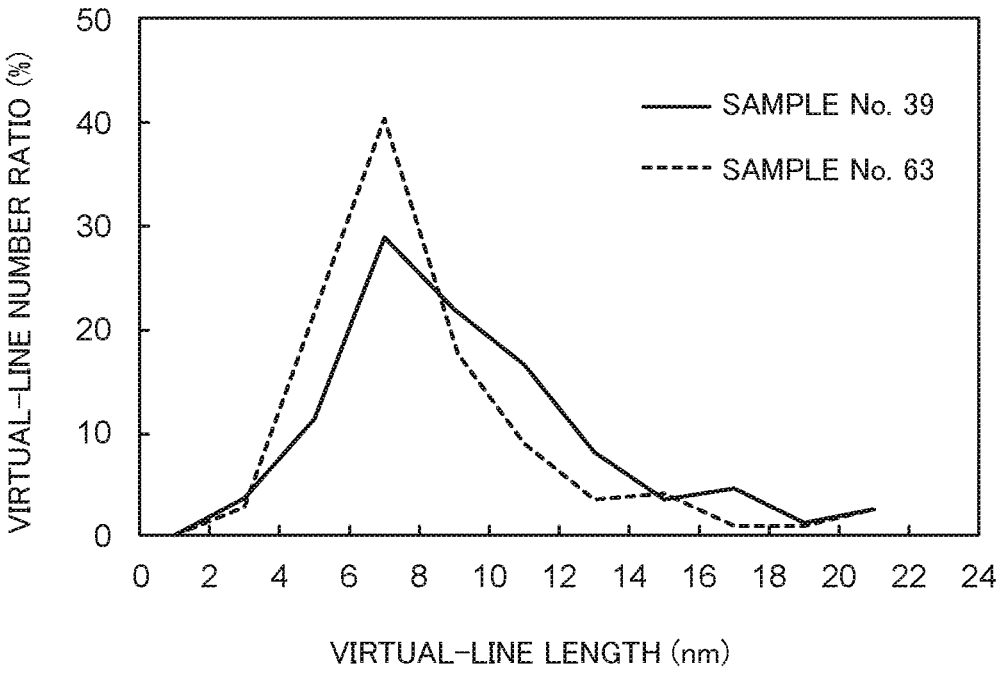
FIG. 9 is a graph showing a relation between a virtual-line length and a virtual-line number ratio in each composition.

A virtual-line number ratio of respective lengths to a virtual length between a maximum point and a maximum point was graphed with respect to Sample No. 39 of Table 2 and Sample No. 63 of Table 3. FIG. 9 shows the graphed results. In FIG. 9, a horizontal axis represents a length of the virtual line, and a vertical axis represents a virtual-line number ratio. In the preparation of the graph of FIG. 9, it is considered that a virtual line having a length of 0 or more and less than 2 nm has a length of 1 nm, a virtual line having a length of 2 nm or more and less than 4 nm has a length of 3 nm, and a virtual line having a length of 4 nm or more and less than 6 nm has a length of 5 nm. The same shall apply hereafter. Then, a ratio of the number of virtual lines to a length of each virtual line is plotted, and the graph was prepared by connecting the plotted points with straight lines. Incidentally, the horizontal axis of FIG. 9 has a unit of nm.

FIG. 9 shows that the Fe—Si-M-B—Cu—C based composition shown in Table 2 has a larger variation of lengths of virtual lines than that of the Fe-M'-B—C based composition shown in Table 3.

As a result of similar examination with respect to Sample No. 120 to Sample No. 159 in Table 5 and Sample No. 194 to Sample No. 213 in Table 6, which had a Fe-M"-B—P—C based composition, it was confirmed that an amorphous phase was formed in a soft magnetic alloy ribbon having an appropriate composition and manufactured at a roll temperature of 70° C. and a vapor pressure of 4 hPa in a chamber. Then, the samples tended to have a network structure of Fe, a low coercivity, and a high permeability by carrying out an appropriate heat treatment. In a sample having less B, P and/or C content, a virtual-line total distance and a virtual-line average distance were larger easily, and favorable characteristics were obtained easily.

As a result of similar examination with respect to Sample No. 214 to Sample No. 223 in Table 7, which had a Fe—Si—P—B—Cu—C based composition, it was confirmed that an amorphous phase was formed in a soft magnetic alloy ribbon having an appropriate composition and manufactured at a roll temperature of 70° C. and a vapor pressure of 4 hPa in a chamber. Then, the samples tended to have a network structure of Fe, a low coercivity, and a high permeability by carrying out an appropriate heat treatment. In a sample having more Si content, a virtual-line total distance and a virtual-line average distance were larger easily, and favorable characteristics were obtained easily. According to Sample No. 214 to Sample No. 217, it was found that favorable characteristics were obtained easily in a sample whose Si content was larger and Fe content was smaller. According to Sample No. 218 to Sample No. 221, it was found that when a total of a Si content and a P content was constant, favorable characteristics were obtained easily in a sample whose P content was larger.

Experiment 3

Pure metal materials were respectively weighed so that a base alloy having a composition of Fe: 73.5 atom %, Si: 13.5 atom %, B: 9.0 atom %, Nb: 3.0 atom %, and Cu: 1.0 atom % was obtained. Then, the base alloy was manufactured by evacuating a chamber and thereafter melting the pure metal materials by high-frequency heating.

Then, the manufactured base alloy was heated and molten to be turned into a metal in a molten state at 1300° C. This metal was thereafter sprayed by a gas atomizing method in predetermined conditions shown in Table 8 below, and powders were prepared. In Experiment 3, Sample No. 104 to Sample No. 107 were manufactured by changing a gas spray temperature and a vapor pressure in a chamber. The vapor pressure was adjusted using an Ar gas whose dew point had been adjusted.

Each of the powders before the heat treatment underwent an X-ray diffraction measurement for confirmation of existence of crystals. In addition, a restricted visual field diffraction image and a bright field image were observed by a transmission electron microscope. As a result, it was confirmed that each powder had no crystals and was completely amorphous.

Then, each of the obtained powders underwent a heat treatment and thereafter measured with respect to coercivity. Then, a Fe composition network was analyzed variously. A heat treatment temperature of a sample having a Fe—Si-M-B—Cu—C based composition was 550° C., a heat treatment temperature of a sample having a Fe-M'-B—C based composition was 600° C., and a heat treatment temperature of a sample having a Fe—Si—P—B—Cu—C based composition was 450° C. The heat treatment was carried out for 1 hour. In Experiment 3, a coercivity of 30 A/m or less was considered to be favorable in the Fe—Si-M-B—Cu—C based compositions (Sample No. 304 and Sample No. 305), and a coercivity of 100 A/m or less was considered to be favorable in the Fe-M'-B—C based compositions (Sample No. 306 and Sample No. 307).

TABLE 8

| SAMPLE NO. | EXAMPLE OR COMPARATIVE EXAMPLE | COMPOSITION | GAS TEMPERATURE (° C.) | VAPOR PRESSURE (h Pa) | NETWORK STRUCTURES VIRTUAL-LINE TOTAL DISTANCE (mm/μm³) |
|---|---|---|---|---|---|
| 304 | Comp. Ex. | Fe73.5Cu1Nb3 Si13.5B9 | 30 | 25 | <1 |
| 305 | Ex. | Fe73.5Cu1Nb3 Si13.5B9 | 100 | 4 | 11 |
| 306 | Comp. Ex. | Fe84Nb7B9 | 30 | 25 | 6 |
| 307 | Ex. | Fe84Nb7B9 | 100 | 4 | 14 |

| | NETWORK STRUCTURES | | | | |
|---|---|---|---|---|---|
| SAMPLE NO. | VIRTUAL-LINE AVERAGE DISTANCE (nm) | VIRTUAL-LINE STANDARD DEVIATION (nm) | EXISTENCE RATIO OF 4 T0 16 nm VIRTUAL LINES (%) | Fe COMPOSTION NETWORK PHASE (vol %) | COERCIVITY (A/m) |
| 304 | — | — | — | — | 38 |
| 305 | 9 | 4.2 | 81 | 35 | 24 |
| 306 | 5 | 2.8 | 56 | — | 280 |
| 307 | 9 | 4.2 | 82 | 36 | 98 |

In Sample No. 305 and Sample No. 307, a favorable Fe network was formed by appropriately carrying out a heat treatment against the completely amorphous powders. In comparative examples of Sample No. 304 and Sample No. 306, whose gas temperature of 30° C. was too low and vapor pressure of 25 hPa was too high, however, the virtual-line total distance and the virtual-line average distance after the heat treatment were small, no favorable Fe composition network was formed, and coercivity was high.

When comparing comparative examples and examples shown in Table 8, it was found that an amorphous soft magnetic alloy powder was obtained by changing a gas spray temperature, and that the virtual-line total distance and the virtual-line average distance increased and a favorable Fe composition network structure was obtained in the same manner as a ribbon by carrying out a heat treatment against the amorphous soft magnetic alloy powder. In addition, coercivity tended to be small by having a Fe network structure in the same manner as the ribbons of Experiments 1 and 2.

NUMERICAL REFERENCES

10 . . . grid
10*a* . . . maximum point
10*b* . . . adjacent grid
20*a* . . . region whose Fe content is higher than a threshold value
20*b* . . . region whose Fe content is a threshold value or less
31 . . . nozzle
32 . . . molten metal
33 . . . roll
34 . . . ribbon
35 . . . chamber

The invention claimed is:

1. A soft magnetic alloy comprising a main component of Fe, wherein the soft magnetic alloy comprises a Fe composition network phase where regions whose Fe content is larger than an average composition of the soft magnetic alloy are linked;

the Fe composition network phase contains Fe content maximum points that are locally higher than their surroundings;

a virtual-line total distance per 1 $\mu m^3$ of the soft magnetic alloy is 10 mm to 25 mm provided that the virtual-line total distance is a sum of virtual lines linking the maximum points adjacent each other; and a virtual-line average distance that is an average distance of the virtual lines is 6 nm or more and 12 nm or less.

2. The soft magnetic alloy according to claim 1, wherein a standard deviation of distances of the virtual lines is 6 nm or less.

3. The soft magnetic alloy according to claim 1, wherein an existence ratio of the virtual lines having a distance of 4 nm or more and 16 nm or less is 80% or more.

4. The soft magnetic alloy according to claim 2, wherein an existence ratio of the virtual lines having a distance of 4 nm or more and 16 nm or less is 80% or more.

5. The soft magnetic alloy according to claim 1, wherein a volume ratio of the Fe composition network phase is 25 vol % or more and 50 vol % or less with respect to the entire soft magnetic alloy.

6. The soft magnetic alloy according to claim 2, wherein a volume ratio of the Fe composition network phase is 25 vol % or more and 50 vol % or less with respect to the entire soft magnetic alloy.

7. The soft magnetic alloy according to claim 3, wherein a volume ratio of the Fe composition network phase is 25 vol % or more and 50 vol % or less with respect to the entire soft magnetic alloy.

8. The soft magnetic alloy according to claim 4, wherein a volume ratio of the Fe composition network phase is 25 vol % or more and 50 vol % or less with respect to the entire soft magnetic alloy.

9. The soft magnetic alloy according to claim 1, wherein a volume ratio of the Fe composition network phase is 30 vol % or more and 40 vol % or less with respect to the entire soft magnetic alloy.

10. The soft magnetic alloy according to claim 2, wherein a volume ratio of the Fe composition network phase is 30 vol % or more and 40 vol % or less with respect to the entire soft magnetic alloy.

11. The soft magnetic alloy according to claim 3, wherein a volume ratio of the Fe composition network phase is 30 vol % or more and 40 vol % or less with respect to the entire soft magnetic alloy.

12. The soft magnetic alloy according to claim 4, wherein a volume ratio of the Fe composition network phase is 30 vol % or more and 40 vol % or less with respect to the entire soft magnetic alloy.

13. The soft magnetic alloy according to claim 1, which has been prepared by a single roll method or a gas atomizing method.

* * * * *